US007104538B1

(12) United States Patent
Kimura et al.

(10) Patent No.: US 7,104,538 B1
(45) Date of Patent: Sep. 12, 2006

(54) SHEET POST PROCESSING DEVICE

(75) Inventors: Kuniaki Kimura, Tokyo (JP); Kiichiro Noguchi, Tokyo (JP); Kenji Umehara, Tokyo (JP); Kenichi Watanabe, Tokyo (JP)

(73) Assignees: Gradco (Japan) Ltd. (JP); Ikegami Communication Equipments, Inc. (JP)

( * ) Notice: Subject to any disclaimer, the term of this patent is extended or adjusted under 35 U.S.C. 154(b) by 0 days.

(21) Appl. No.: 09/356,656

(22) Filed: Jul. 19, 1999

(30) Foreign Application Priority Data

Oct. 26, 1998 (JP) ..... 10 304511
Oct. 26, 1998 (JP) ..... 10 304512

(51) Int. Cl.
*B65H 39/11* (2006.01)

(52) U.S. Cl. ..... 270/291; 270/58.08; 270/58.11; 270/58.13

(58) Field of Classification Search ..... 271/291; 270/58.08, 58.11, 58.13, 58.14, 58.15, 58.12, 270/58.16
See application file for complete search history.

(56) References Cited

U.S. PATENT DOCUMENTS 4,787,616 A * 11/1988 Sasaki et al. ..... 271/3.03
5,362,200 A * 11/1994 Ushirogata ..... 414/791
5,382,012 A * 1/1995 Mandel et al. ..... 270/58.14
5,388,819 A * 2/1995 Ushirogata ..... 271/220
5,692,747 A * 12/1997 Guerrero et al. ..... 271/296
5,704,609 A 1/1998 Mandel et al.
5,971,383 A * 10/1999 Horikawa et al. ..... 270/58.11
5,992,838 A * 11/1999 Saitoh ..... 270/58.09

FOREIGN PATENT DOCUMENTS

JP 10175767 A * 6/1998

* cited by examiner

*Primary Examiner*—Patrick Mackey
(74) *Attorney, Agent, or Firm*—Cohen Sakaguchi & English LLP

(57) ABSTRACT

A sheet post processing device receives, sheets on an inverter structure which causes initial sheets supplied to the inverter to be overlayed first sheet on the second sheet, and moves the overlayed first and second and subsequent sheets to a sheet transport path for delivery to a sheet sending device adapted to be indexed vertically between selective gates and fixed outlets into selected trays, and has a stapler for stapling sheets in sets, before sending the sets to the outlet and into a tray.

12 Claims, 27 Drawing Sheets

SHEET POST PROCESSING DEVICE

BACKGROUND OF THE INVENTION

This invention is related to the sheet post processing device that sorts continuously transported sheets onto several trays.

Previously, a movable tray type with vertically movable trays and a fixed tray type with fixed trays are known to be employed in this type of sheet post processing device. The movable tray type has an outlet in the fixed position to eject continuously transported sheets. Several trays are disposed in a vertically spaced direction and selectively move to the receiving position for the sheets ejected from the outlet. On the other hand, the fixed tray type has several transport paths that transport sheets to the respective tray. By switching those transport paths, sheets are selectively transported onto several trays.

However, among the previous sheet post processing devices, the movable tray type requires a large drive mechanism to move up and down heavily loaded trays due to accumulated sheets. If a sheet is ejected onto a lower tray among several trays that are located in vertically spaced direction, upper trays will significantly move to the top of the sheet infeed expanding large moving space to upper area. On the contrary, the fixed tray type requires several transport paths, complicating and enlarging the composition of the entire device.

There have been devices that transport the sheets that are continuously ejected from a host machine such as a copier or a printer, reverse the transport direction of the sheet, and transport the sheet into the sheet post processing portion of the device that staples and sorts the sheets. Generally, this type of sheet reversing device is incorporated into the sheet post processing device such as a stapler or a sorter.

The previous sheet reversing devices transport each sheet onto the stage, reverse the sheet transporting direction, and transport sheets one by one by converting the trailing end of the sheet to the leading end. After transporting one sheet onto the stage, the device transports the sheet in its reversed transporting direction. Then, after the sheet is transported, the next sheet is transported onto the stage.

However, since the previous sheet reversing device repeats transporting sheets one by one and in a reversed direction on the stage, the next sheet could not be transported onto the stage unless the previously transported sheet on the stage is ejected. Therefore, for example, the sheet reversing device that reverses the sheet ejected from a host machine such as a copier or a printer and transports the sheets into the sheet post processing portion for stapling or sorting takes time. If the sheet is temporarily delayed to be transported into the sheet post processing portion from the stage, the next sheet cannot be transported onto the stage and the host machine such as a copier or a printer has to be temporarily stopped. That is, due to a delay of the movement timing of the transporting destination of the sheet transported from the sheet reversing device, the transportation of the sheets into the sheet reversing device had to be stopped and therefore the speed of sheet processing decreased.

SUMMARY OF THE INVENTION

The sheet post processing device to sort continuously transported sheets into several trays has features of a top infeed to an inverter, a transport path that transports sheets continuously from the inverter, several gates from which a sheet can be taken out along the path, several outlets that can eject sheets from each corresponding fixed location of receiving trays, and the sheet sending device that selectively moves between the several transport gates and the several outlets and sends the sheets transported from the transport gates to the outlets on the other side.

In the sheet post processing device described herein, the sending device is disposed for vertical movement. Sheets can be taken out almost horizontally from several transport gates above the sending device. The several trays are located in fixed positions in a vertical direction. The several outlets are established in fixed positions in a vertical direction corresponding to each tray. The sheet sending device selectively moves up and down between the several transport gates and the several outlets.

The sheet post processing device also has a feature that the transport gates and the outlets open and close by the sheet sending device.

The sheet post processing device, in addition, includes a feature that the sheet sending device accumulates several sheets of papers that have been transported from the transport gate and sends them to the outlets.

The sheet sending device of the sheet post processing device, as described above, has a stapler to staple several sheets of accumulated sheets.

An objective of this invention is to provide the sheet post processing device that can sort several sheets onto several trays while simplifying and reducing the size of the composition of the entire device.

The sheet post processing device described above has a sheet inverting device that reverses the transporting direction of the continuously transported sheets and then sends them by the transport path to the sending device.

Another objective of this invention is to provide a sheet reversing device that can continuously transport sheets without any effects of delayed transporting timing and therefore to process sheets effectively.

The sheet reversing device of this invention establishes upper and lower sheet transporting positions on one side of the stage that can load sheets. After transporting the sheet on the stage, it ejects the sheet from the rear end of the transporting direction as the front end. The device has features of the sheet repositioning device that temporarily reposition the rear end of the transporting direction of the sheet upwardly overlays the next or second received sheet, and the sheet transporting mechanism that simultaneously transports several sheets overlaid on the stage.

DESCRIPTION OF THE PREFERRED EMBODIMENT

Figure 1:
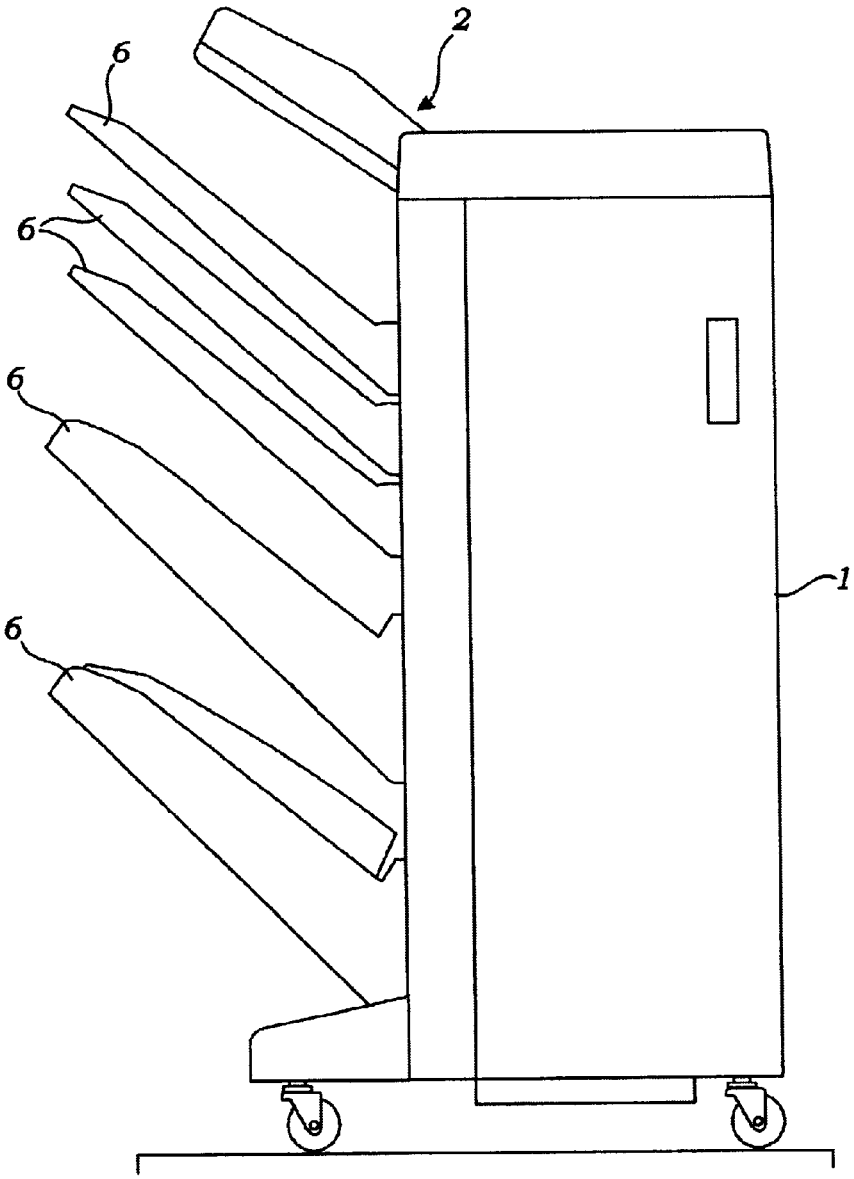
FIG. 1 is a side view of the entire device of this invention in one operation format.
Figure 2:
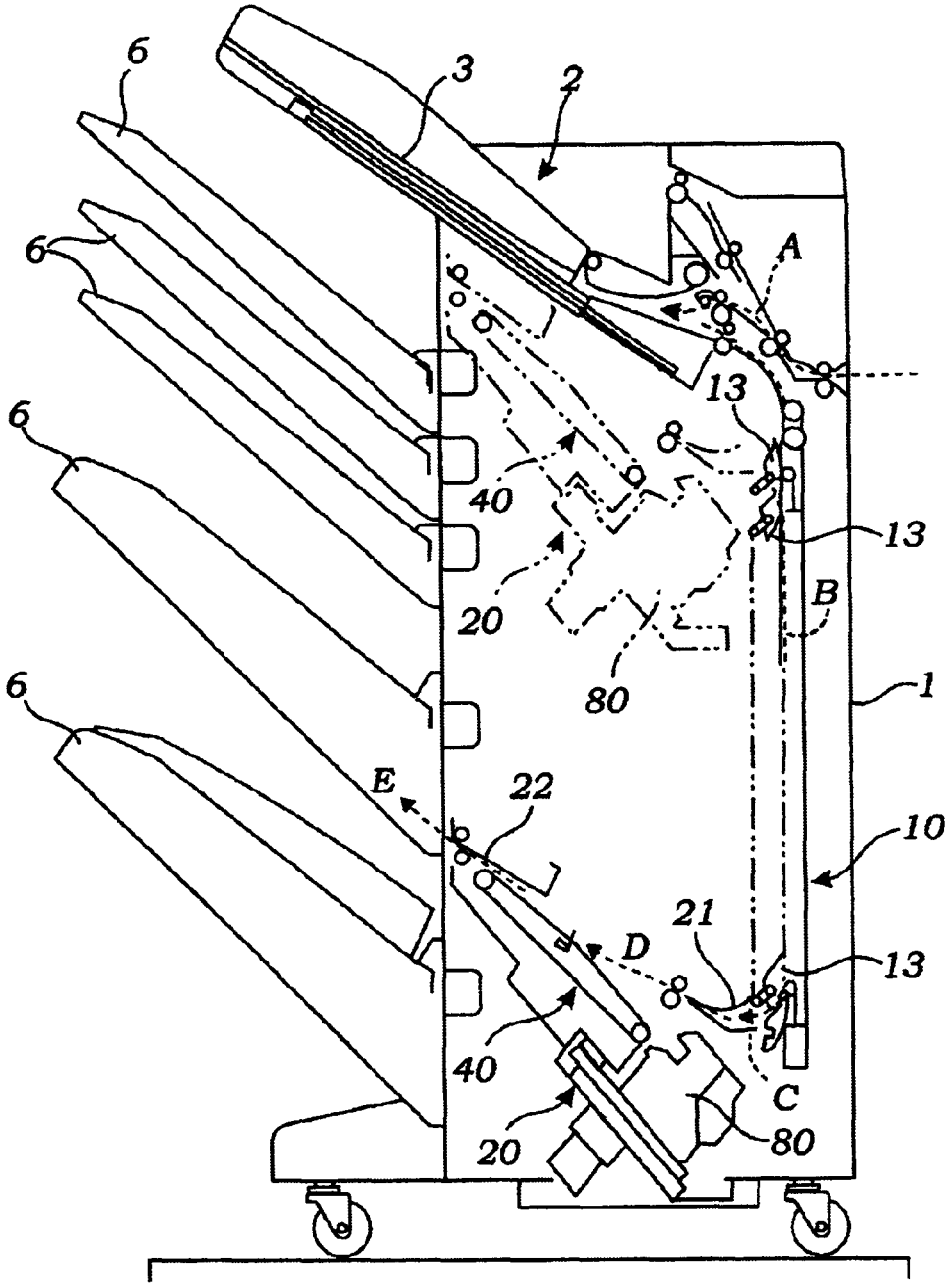
FIG. 2 is a side view to explain the outlined internal composition of the device in FIG. 1.

As seen generally in FIGS. 1 and 2, body 1 of the sheet post processing device, in this example, sorts the sheets that are transported in a reversed direction due to the sheet inverting device 2. That is, a sheet ejected from a host machine such as a copier or a printer is first transported into the sheet reversing device 2 from a direction indicated by the arrow A in FIG. 2. The transport direction of the sheet is reversed by the sheet reversing device 2 and the sheet is transported downwardly in a direction indicated by the arrow B by the transport path 10 on the right side of FIG. 2 of the body 1.

The sheet reversing device 2 transports the sheet from the direction of the arrow A onto the top of the stage 3. It reverses the transporting direction of the sheet by converting the trailing end portion of the sheet to the leading end portion, entering the transport path 10.

Figure 3:
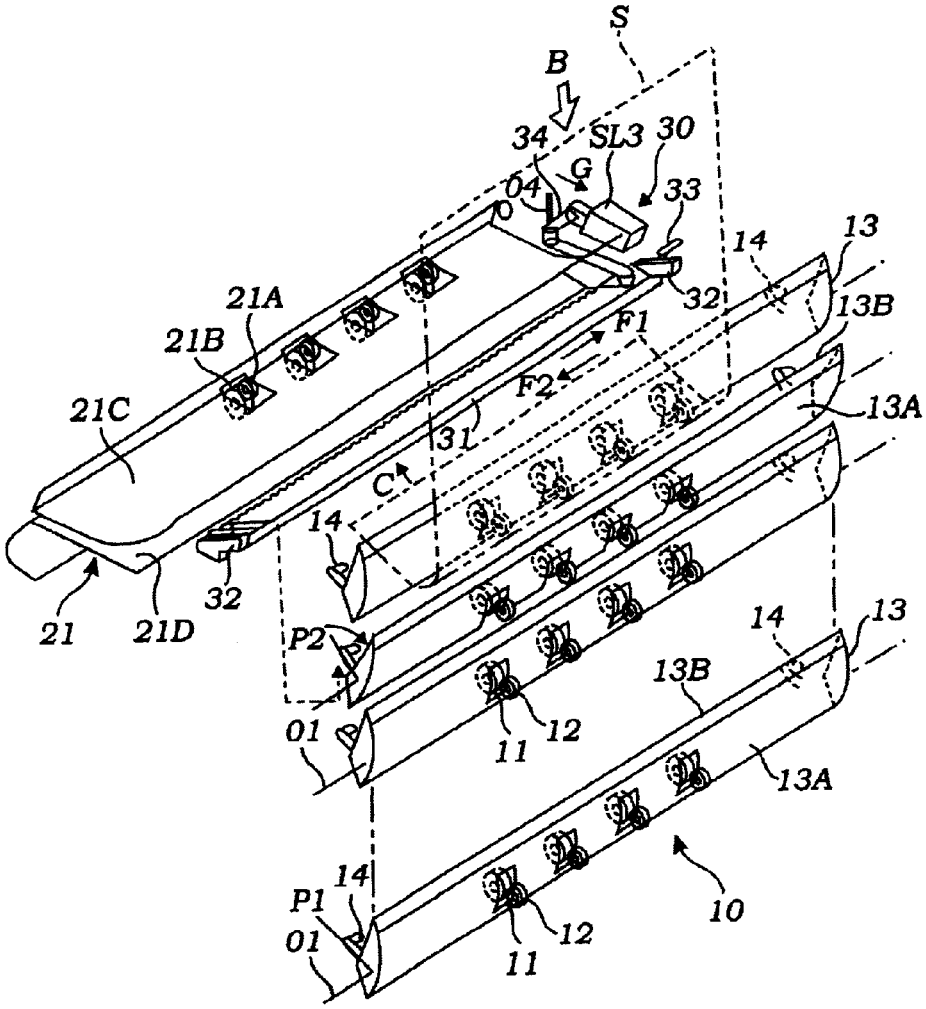
FIG. 3 is a perspective of the transport gate portion of FIG. 2.

The transport path 10 has several pairs of rollers 11 and 12 to transport the sheet by holding it on both sides as indicated in FIG. 3 for movement in the direction of the arrow B. In fixed positions in the transport path 10, there are several transport gates 13 that can direct the sheet into the left side of FIG. 2 from the transport path 10. The transport gates 13 freely pivot around the horizontal shaft line 01 (as indicated in FIG. 3). L-shaped arms 14 are located on both ends of the transport gates 13 and the front end of L-shaped arms swing. The transport gates 13 are set to be in the mode not to collect the sheet without taking it out of the path when its arms 14 are placed in the first rotation position. When its arms 14 are pushed up to the second rotation position as mentioned later, it is set to be in the sheet collection mode to take the sheet out of the path and turning the sheet almost horizontally. In FIG. 3, the second gate from the top is set to be in the sheet collection mode. The sheet S is taken out almost horizontally in the arrow C direction while being guided by the inside 13B of the gate 13. The upper gate 13 in FIG. 3 is set to be in the mode not to collect the sheet. The sheet S is transported downward while being guided by the outside 13A of the gate.

Figure 8:
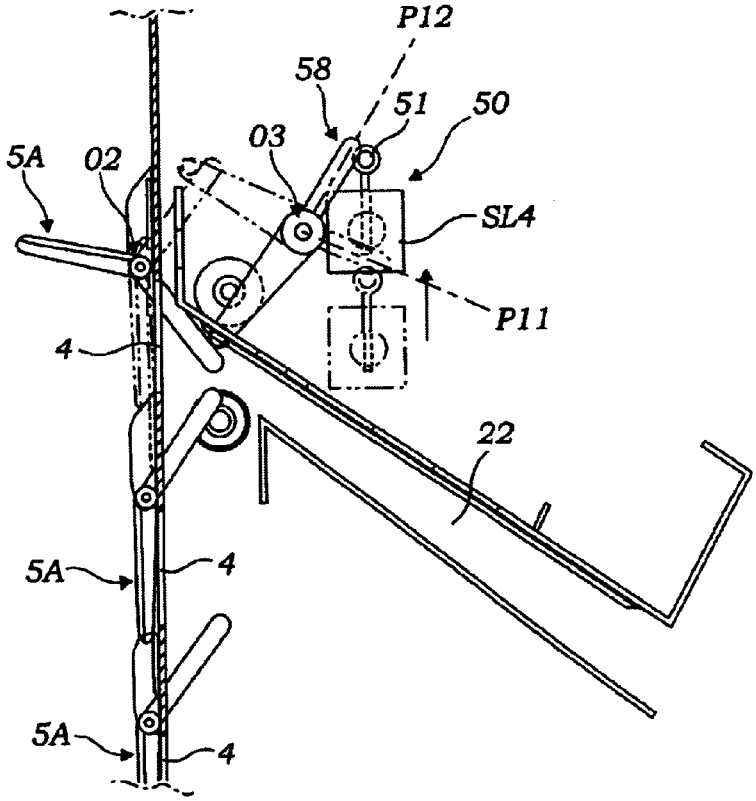
FIG. 8 is a perspective of the sheet transport path portion of the indexer of FIG. 4.

Several outlets 4 that can eject the sheet as shown in FIG. 8 are formed in the fixed position on the left side of FIG. 2 of the body 1. The shutter 5A that can freely rotate around the horizontal shaft line 02 and the link 5B that can freely rotate around the shaft line 03 are located in each outlet 4. When the link 5B is in the first rotation position P11, the shutter 5A closes the outlet 4. When the link 5B is pushed upward to the second rotation position P12 as mentioned later, the shutter 5A opens the outlet 4. Multiple tray installation parts are formed in the positions each corresponding to several outlets 4.

Figure 10:
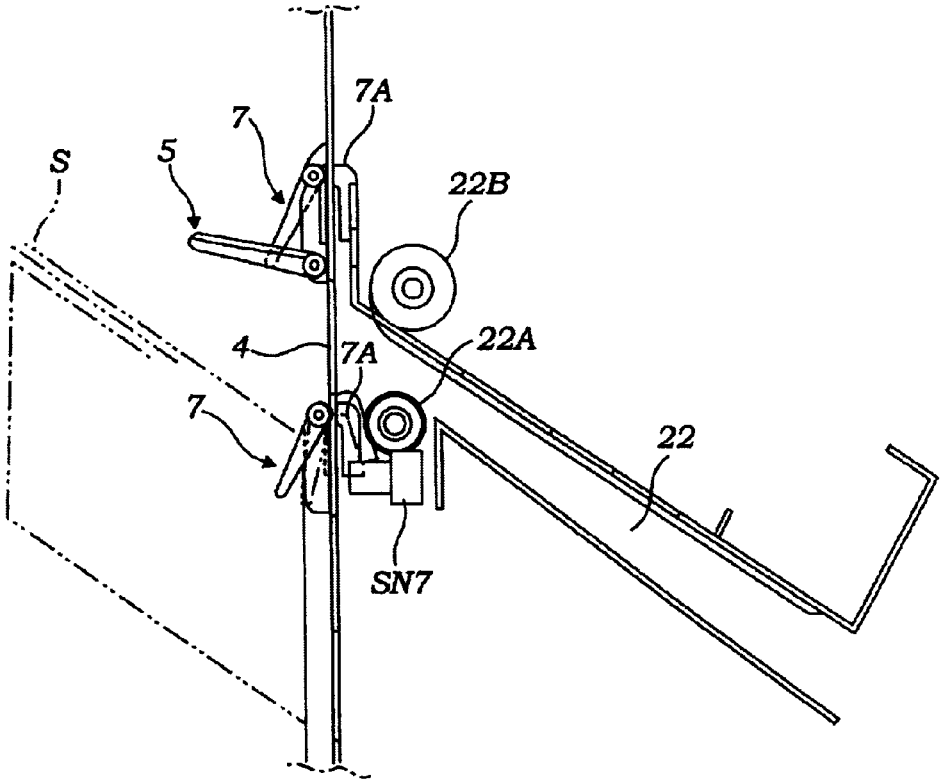
FIG. 10 is a perspective of the outlet portion of FIG. 8.

Tray 6 can be selectively installed into these tray installation parts. The tray 6 receives the sheet from the outlet 4 corresponding to its tray installation and accumulates sheets. Also, the lever 7 that rotates by the accumulated sheets S as indicated in FIG. 10 is located under each outlet 4. This lever 7 rotates by the sheet (as indicated by the two point chain line in FIG. 10) when the sheets are accumulated to its corresponding position. Then, the rear end portion 7A causes the sensor SN7 to turn on switch. This sensor SN7 operates to recognize the fullness of the sheets S and moves the indexer or sending device 20 one step upward to move the outlet 4 that ejects the sheets S one step upward.

The indexer or sending device 20 is located between the transport gate 13 in the transport path 10 and the outlet 4 inside of the body 1 to move up and down. The indexer or sending device 20 transports the sheet S from the arrow D direction through the sheet transport path 21 on the right side of FIGS. 2 and 4. It loads the sheet S on the belt or stage 23 (see FIG. 4) and transports the sheet toward the arrow E direction and through the sheet transport path 22 on the top left portion in FIGS. 2 and 4.

In this case, the indexer 20 can be set in the first operation mode (stapling stack mode) that staples and transports several sheets S accumulated on the stage 23 and the second operation mode (simple stack mode) that simply transports the sheets one by one. The sheet path 21 selectively faces to the transport gates 13 according to up and down movement of the indexer or sending device 20. The sheet path 21 transports the sheets S that are taken out toward the arrow C direction from the transport gate 13 on the opposite side. Also, the sheet transport path 22 selectively faces the outlet 4 according to up and down movement of the indexer or sending device 20.

Figure 4:
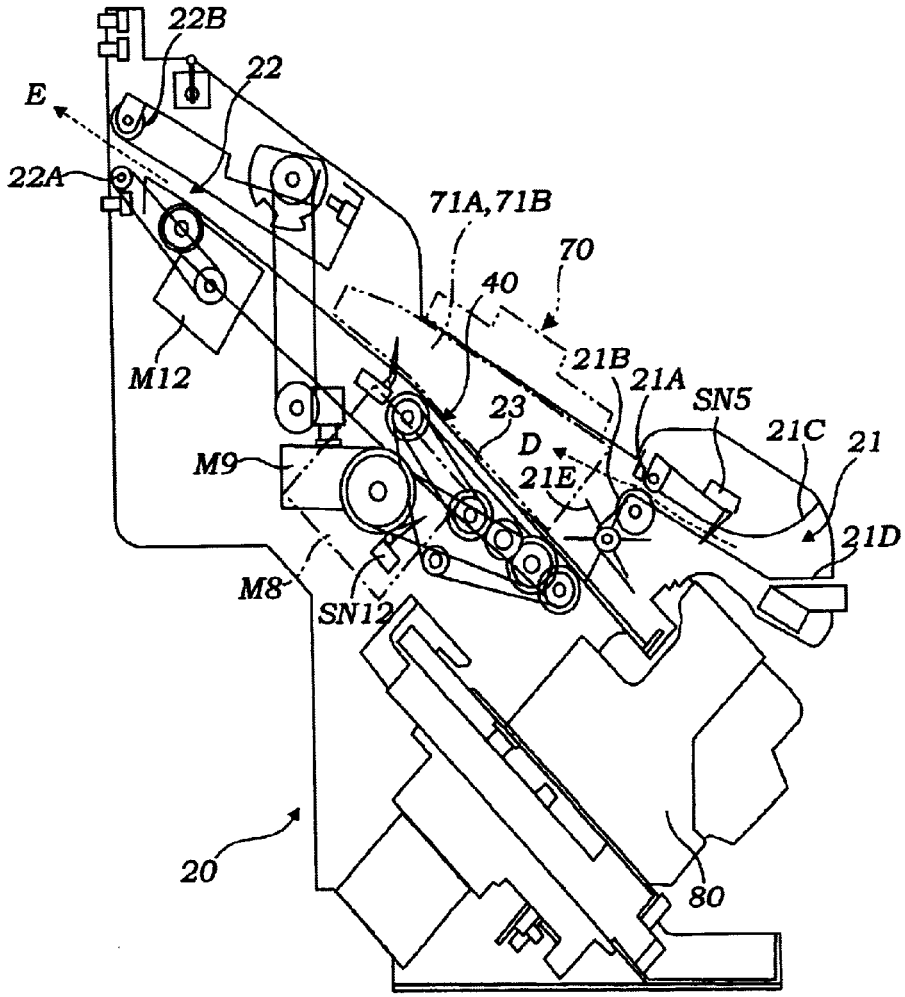
FIG. 4 is a perspective showing the indexer portion of FIG. 2.

The transport path 21 consists of upper and lower rollers 21A and 21B and upper and lower guide plates 21C and 21D. The roller 21B is rotated by the entrance motor (M4) that is not shown. 21E in FIG. 4 is a ribbed hitting roller to push down the rear end of the sheets S that are transported from the sheet transport path 21 in a transport direction onto the stage 23. SN5 in FIG. 4 is the entrance sensor to detect the transportation of the sheet S in to the sheet transport path 21.

The gate drive mechanism 30 (seen in FIG. 3) to set the transport gate 13 facing the sheet transport path 21 into the sheet collection mode is located near the sheet transport path 21. The gate drive mechanism 30 has the slider 31 to slide left to right in a horizontal direction by the solenoid SL3. The connections 31 on the both ends of the slider 31 set apart from the connection to the arm 14 of the transport gate 13 when the slider 31 is moved to the arrow F1 direction by the spring 33. In this case, the indexer 20 moves up and down without interference of its connection 32 with the arm 14. On the other hand, the connection 32 moves to the connection to the arm 14 when the link 34 rotates around the shaft line 04 and the slider 31 slides toward the arrow F2 direction. At this time, the indexer 20 moves upward and the connection 32 lifts up the arm 14 of the transport gate 13 facing the transport path 21. The transport gate 13 is set to be in a sheet collection mode.

The sheet transport path 22 of the indexer 20 has the lower drive roller 22A that is moved on the belt by the transport motor M12 as indicated in FIG. 4 and the upper pinching roller 22B that is moved up and down by the pinching pressure motor M9. The pinching roller 22B creates pinching pressure by moving downward due to regular rotation of the pinching pressure motor M9. It releases the pinching pressure by moving upward due to the reverse rotation of the pinching pressure motor M9. The drive roller 22A transports the sheets S on the stage 23 in the arrow E direction by rotating by the transport motor M12.

Figure 9:
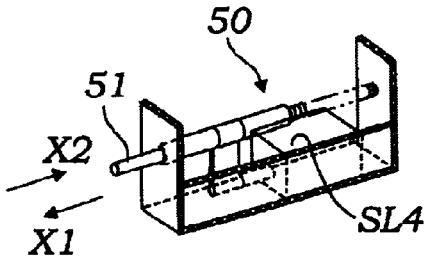
FIG. 9 is a perspective of the shutter drive mechanism of FIG. 8.

Referring to FIGS. 8 and 9, the shutter drive mechanism 50 to open the shutter 5A of the outlet 4 facing the sheet transport path 22, is located near the sheet transport path 22. The drive mechanism 50 has the pin 51 that is caused to slide left to right horizontally by the solenoid SL4.

When the pin 51 slides toward the arrow X2 direction, its front end portion is set apart from the connection to the link 5B. In this case, the indexer 20 moves up and down without interference of the front end portion of the pin 51 with the link 5B. On the contrary, when the pin 51 slides in the arrow X1 direction, its front end portion moves into connection with the link 5B. At this time, the indexer 20 moves upward and the front end portion of the pin 51 lifts up the link 5B of the outlet 4 facing the sheet transport path 22 as indicated by the solid line in FIG. 8 to open the shutter 5A of the outlet 4.

Figure 5:
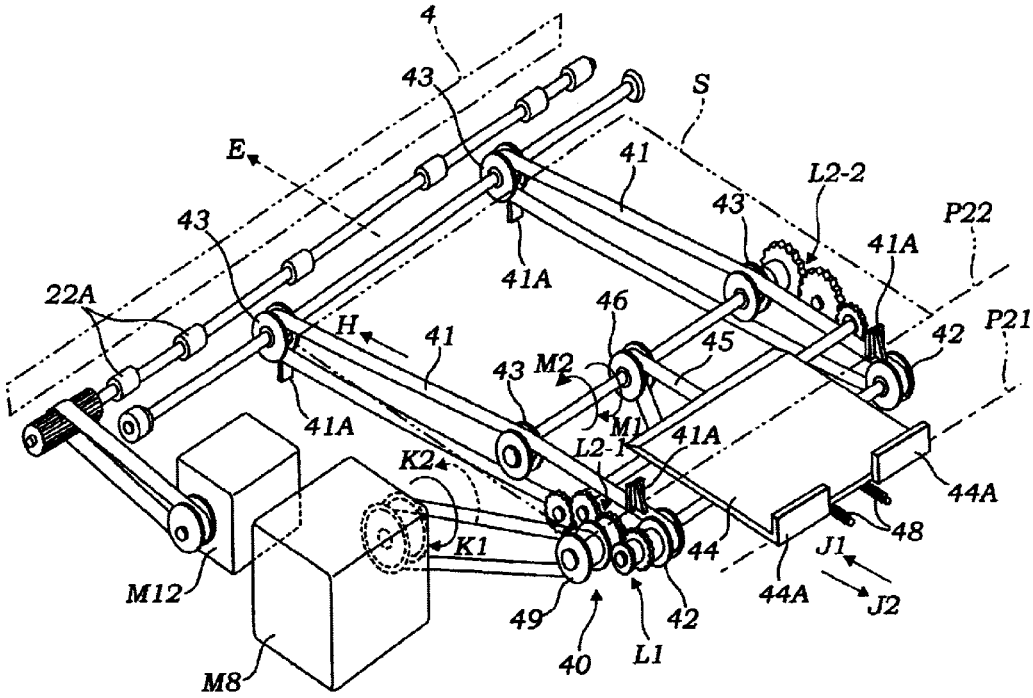
FIG. 5 is a perspective of the sending mechanism portion of the indexer of FIG. 4.
Figure 6:
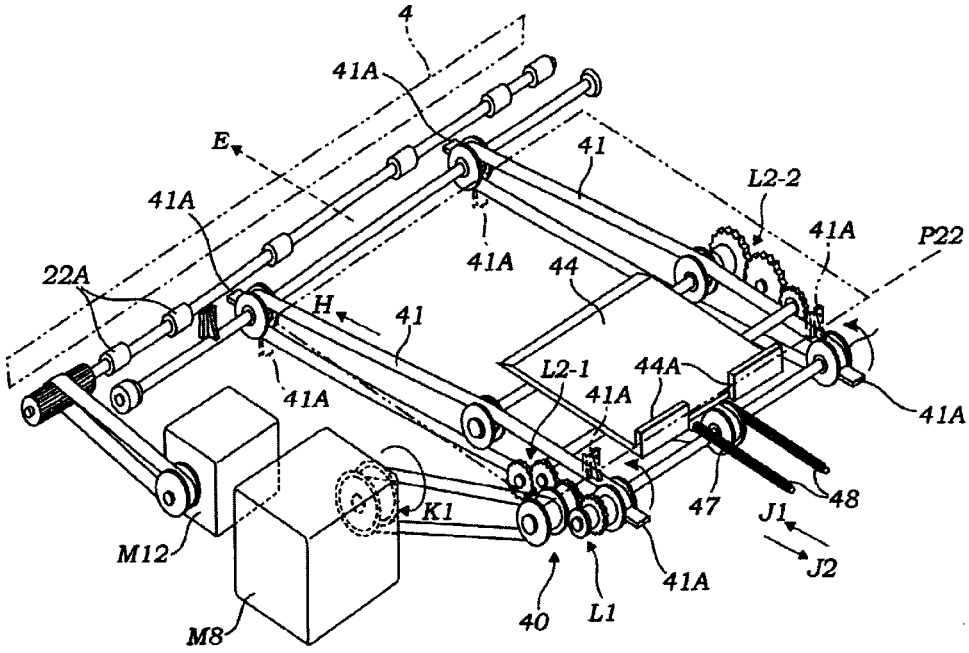
FIG. 6 is a perspective of the sending mechanism portion of FIG. 5 in another movement mode.
Figure 7:
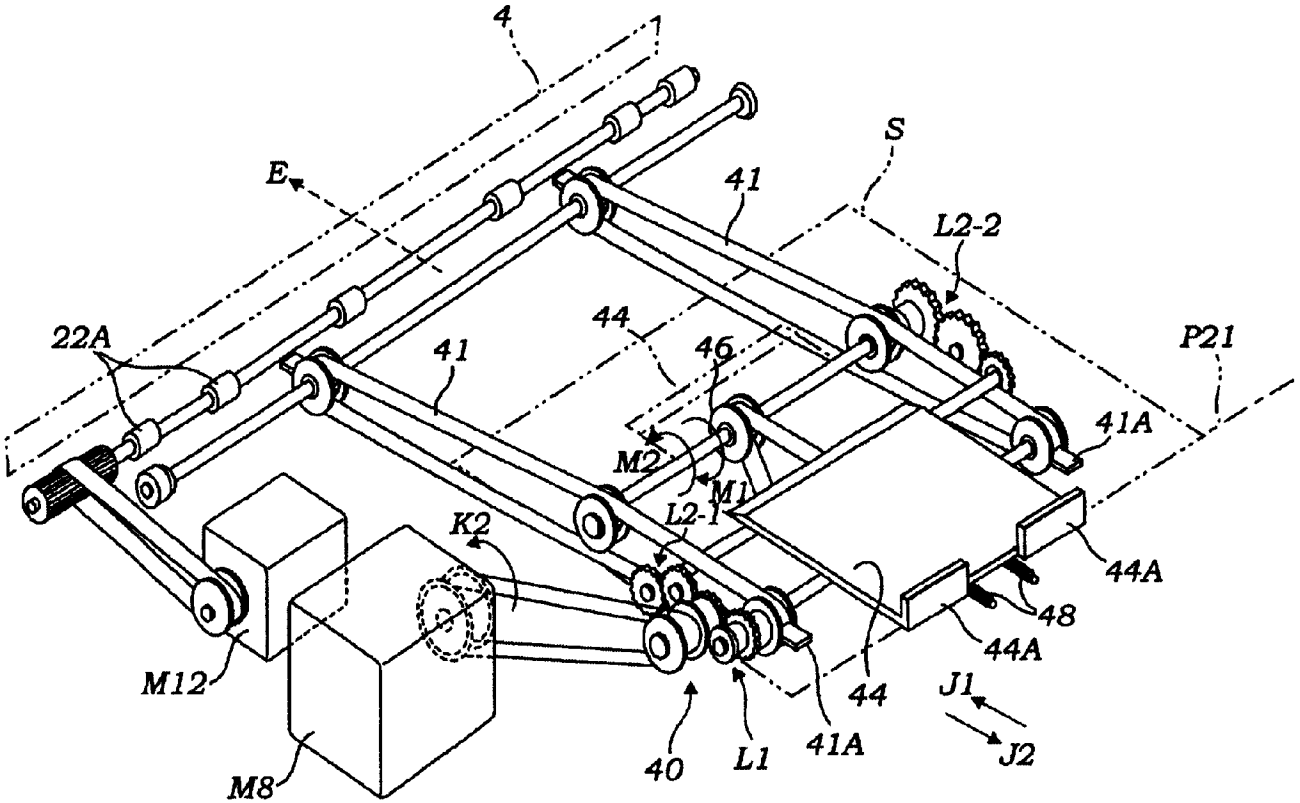
FIG. 7 is a perspective of the sending mechanism portion of FIG. 5 in a further movement mode.

Referring to FIGS. 4 through 7, the sending mechanism 40 to send the transported sheets S is located on the stage 23 of the indexer or sending device 20. Belts 41 in FIGS. 5, 6 and 7 are left and right sending belts and are hung between the drive pulley 42 and the follower pulley 43. The sending belt 41 has pins 41A in 2 positions in equal distance in a lengthwise direction. The sending belt 51 pushes the rear end of the sheet S to the arrow E direction by sending pins 41A in their standing position on the stage 23 to the arrow H direction. 43 is a free rotating guiding roller to guide the middle portion of the sending belt 41.

At 44 is the slide plate that has the standing portion 44A on the rear end. It is located almost on the same side as accumulating stage 23 and can slide in the arrow J1 and J2 directions. The slide plate 44 is connected to the belt 45 and the belt 45 is hung between the drive pulley 46 and the free rotating follower pulley 47 (see FIG. 6). The slide plate 44 slides in the arrow J1 and J2 directions between the stapling position P21 in FIG. 5 and the sending start standard position P22 in FIG. 1 according to the moving direction of the belt 45. At 48 is the spring that moves the slide plate 44 toward the arrow J2 direction. Also, SN12 in FIG. 4 is a sending belt home sensor and turns on when the standing portion 44A of the slide plate 44 moves to the prepared position.

The drive pulley 42 of the sending belt 41 and the drive pulley 46 of the slide plate 44 are rotated by separate drive systems ("the first drive system" and "the second drive system" respectively) that have the same sending motor M8.

The first drive system consists of a gear series L1 with a one direction clutch. It transfers only the rotation of the pulley 49 to the drive pulley 42 when the sending motor M8 rotates in the arrow K1 direction. Therefore, the drive pulley 42 rotates in the arrow L direction only when the sending motor M8 rotates in the regular arrow K1 direction. It does not rotate when the sending motor M8 rotates in a reverse arrow K2 direction. On the contrary, the second drive system consists of left and right gear rows L2-1 and L2-2 and the one direction clutch is incorporated in the gear row L2-2. The drive pulley 46 rotates in the arrow M2 direction only when the sending motor M8 rotates in a reverse arrow K2 direction and the slide plate 44 slides in the arrow J1 direction. On the contrary, when the sending motor M8 rotates in the arrow K1 direction, the drive pulley 46 can freely rotate in the arrow M1 direction and the slide plate 44 returns to the arrow J2 direction by the spring 48.

Figure 11:
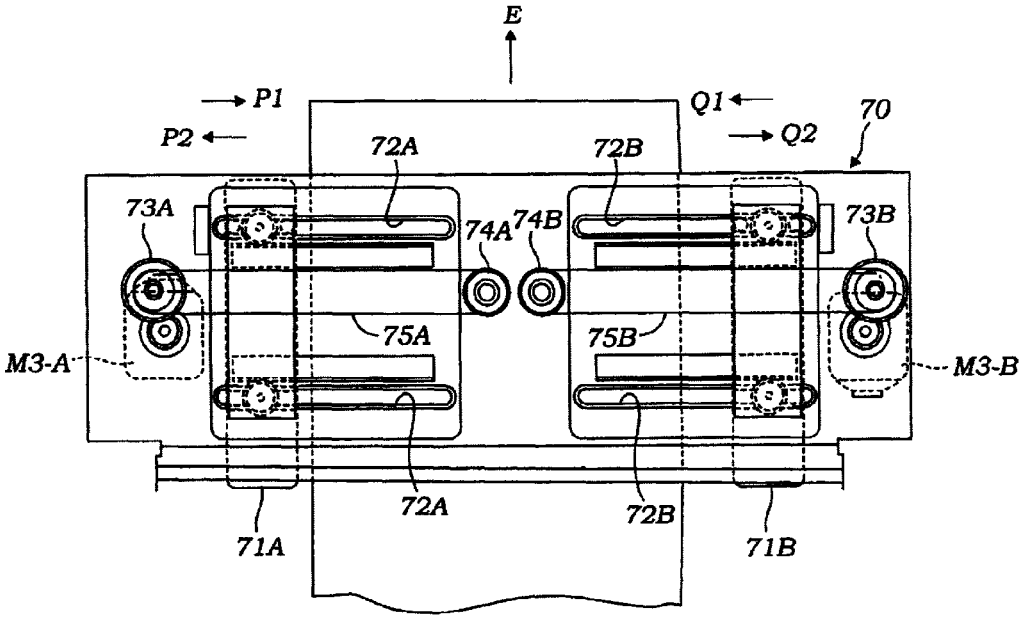
FIG. 11 is a view of the sheet arrangement mechanism installed in the indexer of FIG. 4.
Figure 12:
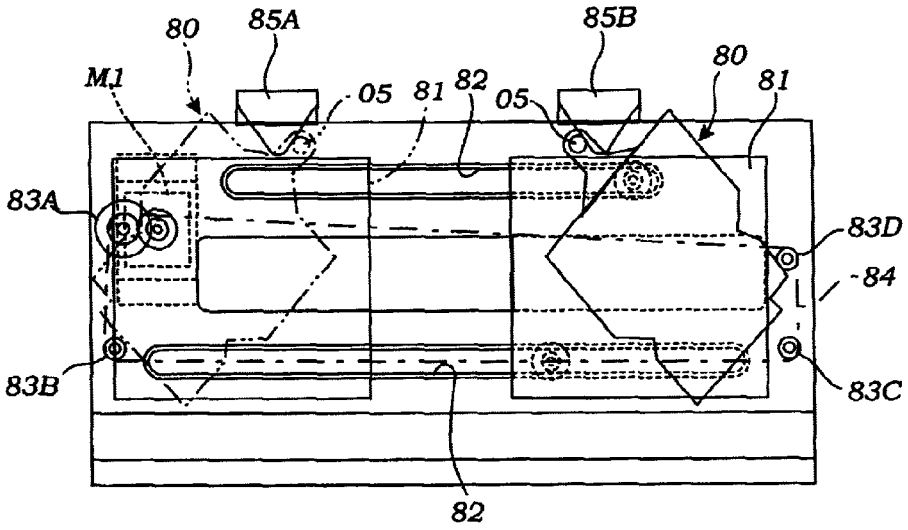
FIG. 12 is a view of the movement mechanism of the stapler installed in the indexer of FIG. 4.

Also, as seen in FIGS. 4, 11 and 12, the indexer 20 has the sheet arrangement mechanism 70 to arrange the sheet S on the stage 23 from left and right directions. In FIG. 11, 71A and 71B are left and right guide plates and they are guided to be able to slide in the left and right arrows P1, P2 and Q1, Q2 directions by the guide slots 72A and 72B. The left guide plate 71A is connected to the belt 75A that is hung between the pulleys 73A and 74A. It slides to left and right arrows P1 and P2 directions by being rotated by the sheet arrangement motor M3-A. Similarly, the right guiding plate 71B is connected to the belt 75B that is hung between the pulleys 73B and 74B. It slides to left and right arrows Q1 and Q2 directions by being rotated by the sheet arrangement motor M3-B.

Motors M3-A and M3-B are relatively controlled. When each motor rotates in a regular direction, left and right guiding plates 71A and 71B slide to the arrows P1 and Q1 directions that are closely connected to arrange the sheet S. When each motor rotates in a reverse direction, left and right guiding plates 71A and 71B slide to the arrows P2 and Q2 that are apart from each other to release the sheet arrangement.

Furthermore, the indexer 20 has the stapler 80 to staple the rear end of the sheets accumulated on the stage 23. The stapler 80 in this example can selectively move to a position to staple the rear right end of the sheets as indicated by the solid line in FIG. 12 and to a position to staple the rear left end of the sheets as indicated by the two point chain line in FIG. 12. That is, the stapler 80 is equipped to be freely rotated around the shaft line 05 on the slider 81. The slider 81 is guided to be able to slide in left and right directions by the guiding slot 82. The slider 81 is connected to the belt 84 that is hung through the pulleys 83A, 83B, 83C and 83D and slides left and right when the pulley 83A is rotated by the motor M1 seen in FIG. 12.

Reference characters 85A and 85B are left and right stoppers that are fixed in the fixed positions. As indicated by the solid line in FIG. 12, when the slider 81 slides to the right, the right stopper 85B directly connected to stapler 80 and the stapler 80 rotates to the position to staple the rear right portion of the sheet. Also, as indicated by the two point chain line in FIG. 12, when the slider 81 slides to the left, the left stopper 85A directly connects to the stapler 80 and the stapler 80 rotates to the position to staple the rear left portion of the sheet.

The indexer 20, as mentioned before, selects the transport gate 13 that transports the sheet S and the outlet 4 that ejects the sheet S according to the movement position in up and down direction. That is, the indexer 20 receives the sheet S from a corresponding transport gate 13 and then ejects the sheet S from the corresponding outlet 4 according to the first and second movements as mentioned later. Therefore, by installing the tray 6 to the outlet 4, the indexer 20 can sort the sheet S or a pile of sheets onto the multiple trays 6. For example, the indexer can also cause each tray 6 to function as a mailbox. In the cases of FIGS. 1 and 2, a total of five trays 6 are installed and the bottom tray 6 is a large capacity tray. When the sheet S or a pile of sheets fill up on the tray 6, the sensor SN7 detects the fullness.

Also, by assigning several outlets 4 to one tray 6 to store the sheet S or a pile of sheets ejected from these outlets 4 in one tray 6, the storage capacity of the tray 6 can be expanded. In that case, by using several sensors SN7 corresponding to each outlet 4 that is assigned to one tray 6, the outlet 4 that should eject the sheet S or a pile of sheets can be selected to switch from the bottom, in order, according to the increase of accumulated amount of the sheet S or a pile of sheets on one tray 6.

Figure 15:
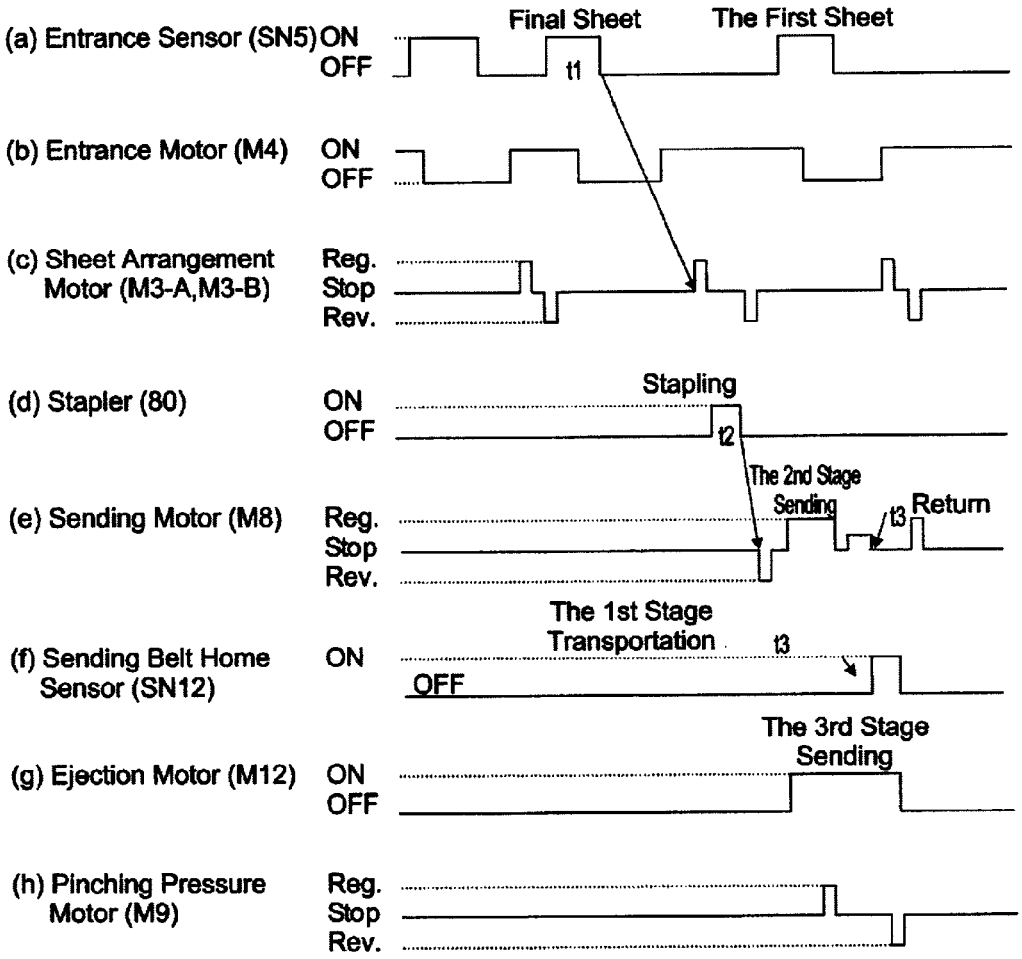
FIG. 15 is a timing chart to show the movement when the first movement mode of the device in FIG. 1 is established.

FIG. 15 is a time chart to explain the movement of the indexer 20 at the time of establishment of the "first movement mode".

When establishing the first movement mode, the slide plate 44 is located in the stapling position P21 as shown in FIG. 7 and the nail 41A of the sending belt 41 is located on the bottom of the stage 23. The rear end of the sheet S that is transported onto the stage 23 of the indexer 20 is located in the stapling position P21 by the standing portion 44A of the slide plate 44 as indicated by the two point chain line in FIG. 7. The sheets S that are transported onto the stage 23 in this manner accumulate and form a pile of sheets.

Regarding the final sheet S of the pile of sheets, the transportation of the final sheet S is detected by the entrance sensor SN5 (see FIG. 4) as shown in FIG. 15 at (a). Then, the entrance motor M4 (not shown) to rotate the roller 21B of the sheet transport path 21 is turned on as shown in FIG. 15 at (b) and the final sheet S is transported onto the stage 23. After the specified time from the declining point t1 of the detection signal of the entrance sensor SN5, the sheet arrangement motors M3-A and M3-B rotate in a regular direction and the guiding plates 71A and 71B of the sheet arrangement mechanism 70 move toward one another to arrange the sheets.

The stapler 80 staples a pile of sheets that has been arranged by the guiding plates 71A and 71B as shown in FIG. 15 at (d). then, the sheet arrangement motors M3-A and M3-B rotate in a reverse direction, as shown in FIG. 15 at (c). After the guiding plates 71A and 71B separate and release the sheet arrangement, the pile of sheets that have already been stapled is sent in three stages.

In other words, first of all, during the first stage, the sending motor M8 rotates in a reverse direction, as shown in FIG. 15 at (e) and the slide plate 44 slides to the sending start standard position P22 to send a pile of sheets as indicated in FIG. 6.

During the second stage, the sending motor M8 rotates in a regular rotation and the pin 41A of the sending belt 41 moves to the sending start standard position P22 that is indicated by the two point chain line in FIG. 6. Then, it further moves to the arrow H direction to send a pile of sheets. Then, the sending motor M8 further rotates in a regular direction to the point t3that turns on the sending belt home sensor SN12 (see FIG. 4), and a pile of sheets is definitely sent to the sheet transport path 22. At step 57, at this point, since the transport motor M12 turns on as shown in FIG. 15 at (g) and the pinching pressure is created when the pinching pressure motor M9 rotates in a regular direction as shown in FIG. 15 at (h), the sheet transporting path 22 can be activated, and, therefore, during the third stage, the sheet transport path 22 sends the sheets.

The pinching pressure motor M9 rotates in a reverse direction to release pinching pressure and the sending motor M8 rotates in a regular direction to return the sending belt 41 to the initial position in FIG. 7. That is, one of two nails 41A on the sending belt 41 that was previously sending a pile of sheets in the second stage as indicated in FIG. 7, and the other nail 41A positions itself to be a waiting position to send the next pile of sheets as indicated in the right side of FIG. 7.

The sheet S that consists the next pile of sheets is transported onto the stage 23. Sheet arrangement motors M3-A and M3-B arrange sheets by repeating regular and reverse rotations every time when the sheet S is transported as indicated in FIG. 15 at (c).

Figure 13:
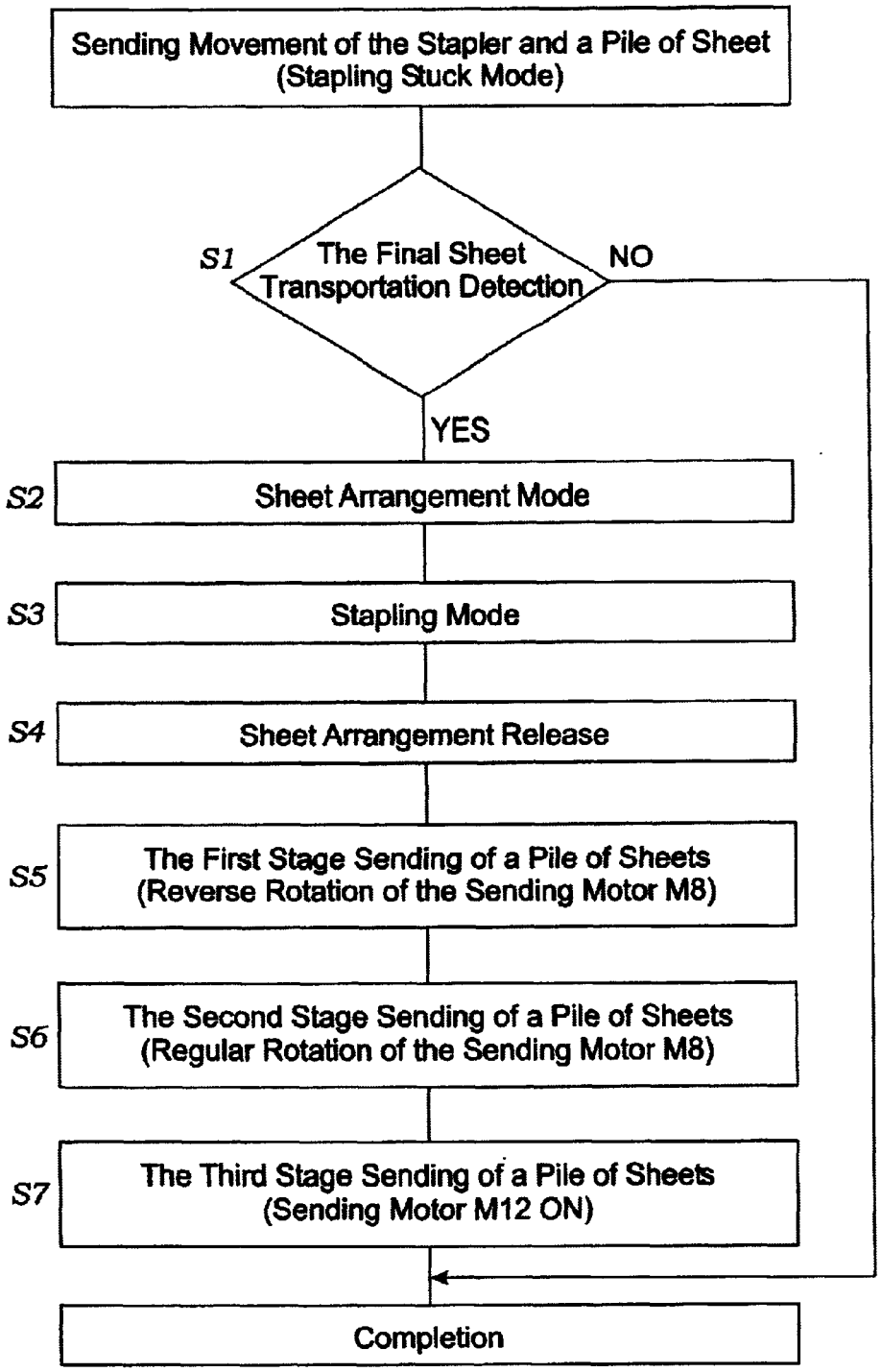
FIG. 13 is a flow chart to show stapling and sending movement of a pile of sheets.

FIG. 13 is a flow chart to explain the stapling in the described above "first movement mode" and the sending movement of a pile of sheets. That is, when the final sheet S composed of a pile of sheets is transported (step S1), the sheet S is stapled while being arranged (steps S2 and S3), then the sheet arrangement movement is released (step S4) and a pile of sheets is sent to the third stage as described above (steps S5, S6 and S7).

Figure 16:
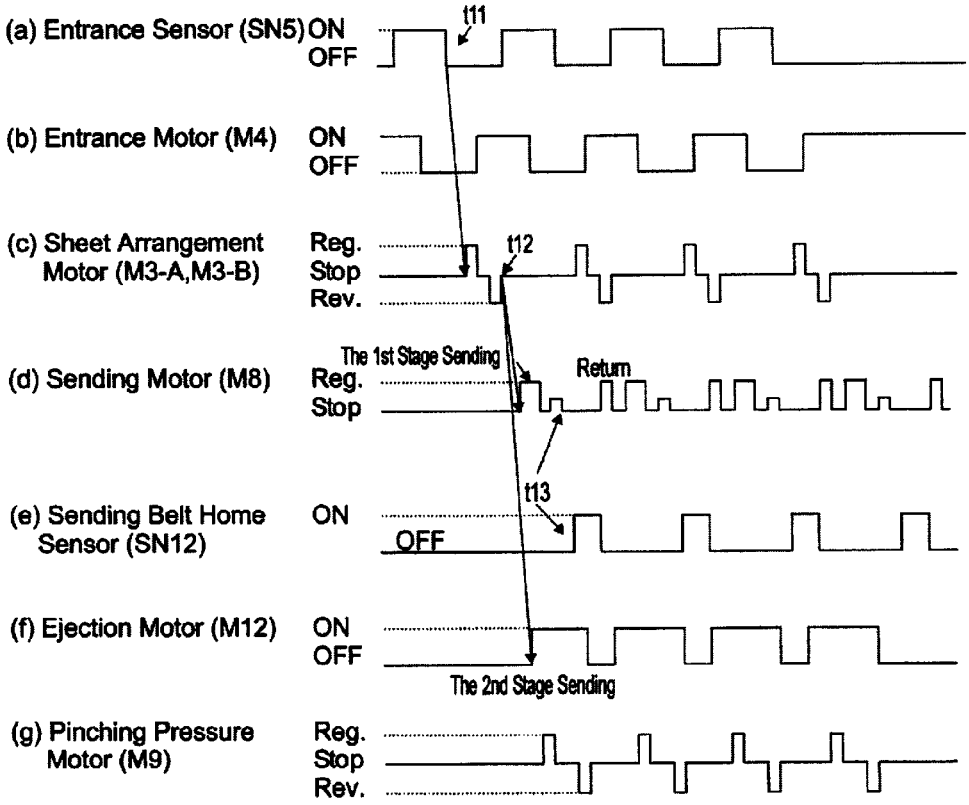
FIG. 16 is a timing chart to show the movement when the second movement mode of the device in FIG. 1 is established.

FIG. 16 is a time chart to explain the movement when the indexer 20 is in the "second movement mode".

When the second movement mode is being established, the slide plate 44 moves away to the staple P21 position as indicated in FIG. 5 and the nail 41A of the sending belt 41 positions itself on top of the stage 23 in the sending start position P22. Therefore, the rear end of the sheet S transported onto the stage 23 of the indexer 20 is positioned in the sending start position P22 by the nail 41A of the sending belt 41 as indicated in the two point chain line in FIG. 5. Then, the sheet S is transported onto the stage 23 in this manner one by one.

First of all, the transportation of the sheet S is detected by the entrance sensor SN5 (see FIG. 4) as indicated in FIG. 16 at (a). The entrance motor M4 to rotate the roller 21B of the sheet transport path 21 is then turned on as indicated in FIG. 16 at (b) and the sheet S is transported onto the stage 23.

Then, after the specified time passes after the starting time t11 when a detection signal of the entrance sensor SN5 is activated, the sheet arrangement motors M3-A and M3-B rotate in a regular direction, then in a reverse direction as indicated in FIG. 16 at (c) and the sheet arrangement mechanism 70 arranges the sheet and releases the sheet arrangement.

That is, first of all, the sending motor M8 reverses in a regular direction as indicated in FIG. 16 at (d) during the first stage and the nail 41A of the sending belt 41 moves toward the arrow H direction from the sending start position P22 in FIG. 5 to send the sheet S. Then, the sending motor M8 further rotates in a regular direction until the sending belt home sensor SN12 (see FIG. 4) is turned on (t13) and the sheet S is sent into the sheet transport path 22. At this time, since the transport motor M12 is turned on as indicated in FIG. 16 at (f) and the pinching pressure motor M9 rotates in a regular direction to create pinching pressure, the sheet transport path 22 has already been in the transportable condition. Therefore, the stage 23 is to send the sheet by the sheet transport path 22.

Then, the pinching pressure motor M9 rotates in a reverse direction to release pinching pressure and the sending motor M8 rotates in a regular direction to return the sending belt 41 to the initial position in FIG. 5. That is, one of two nails 41A on the sending belt 41 that was sending the sheet S during the first stage positions itself as indicated in the left side of FIG. 5 and the other nail 41A positions itself to wait for the next sheet to be sent in the sending start position P22 as indicated in the right side of the same figure.

Similarly, the sheet S to be transported onto the stage 23 is transported one by one.

Figure 14:
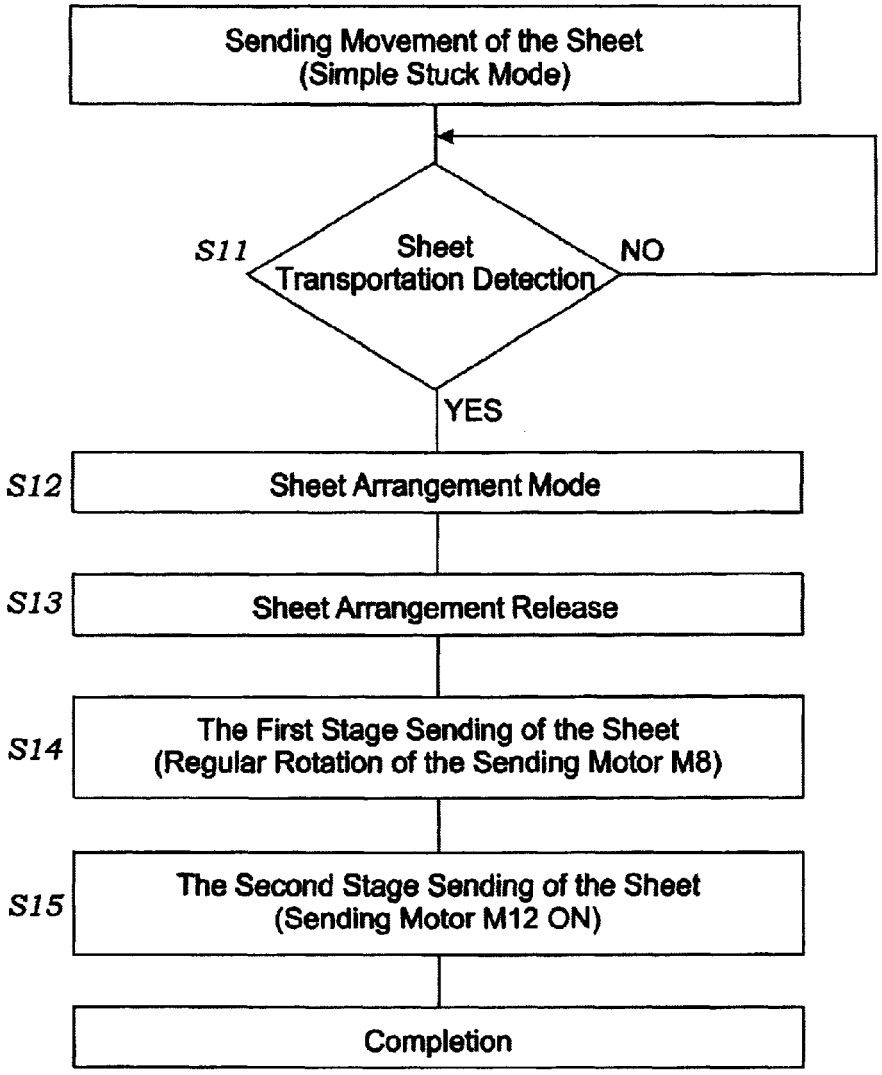
FIG. 14 is a flow chart to show the sheet sending movement of the device in FIG. 1 without stapling.

FIG. 14 is a flow chart to explain the sheet sending movement in the "second movement mode" described above. That is, when the sheet S is transported (step S11) the sheet is arranged. After the sheet is arranged and then that arrangement is released (steps S12 and S13), the sheet S is transported to the second stage as described above (steps S14 and S15).

Figure 17:
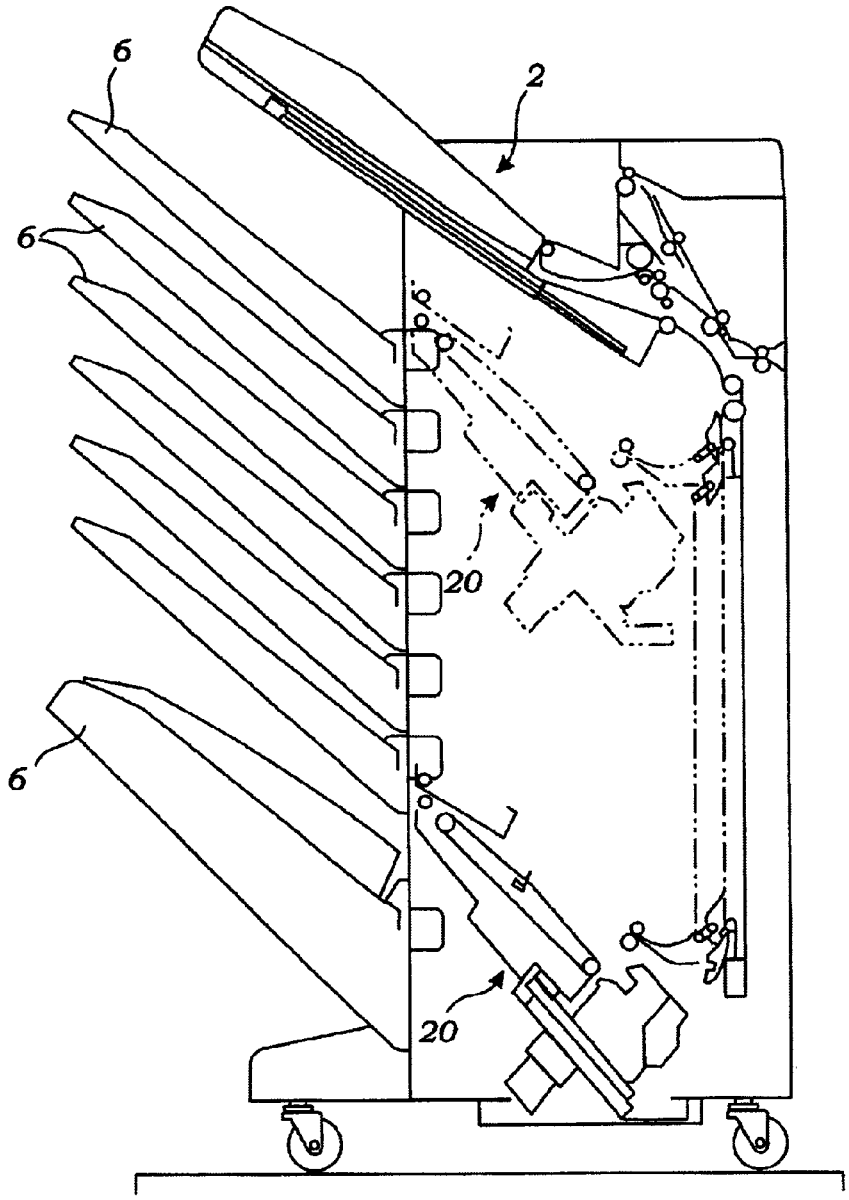
FIG. 17 is a side view to show another installation format of the tray in the device of FIG. 1.
Figure 18:
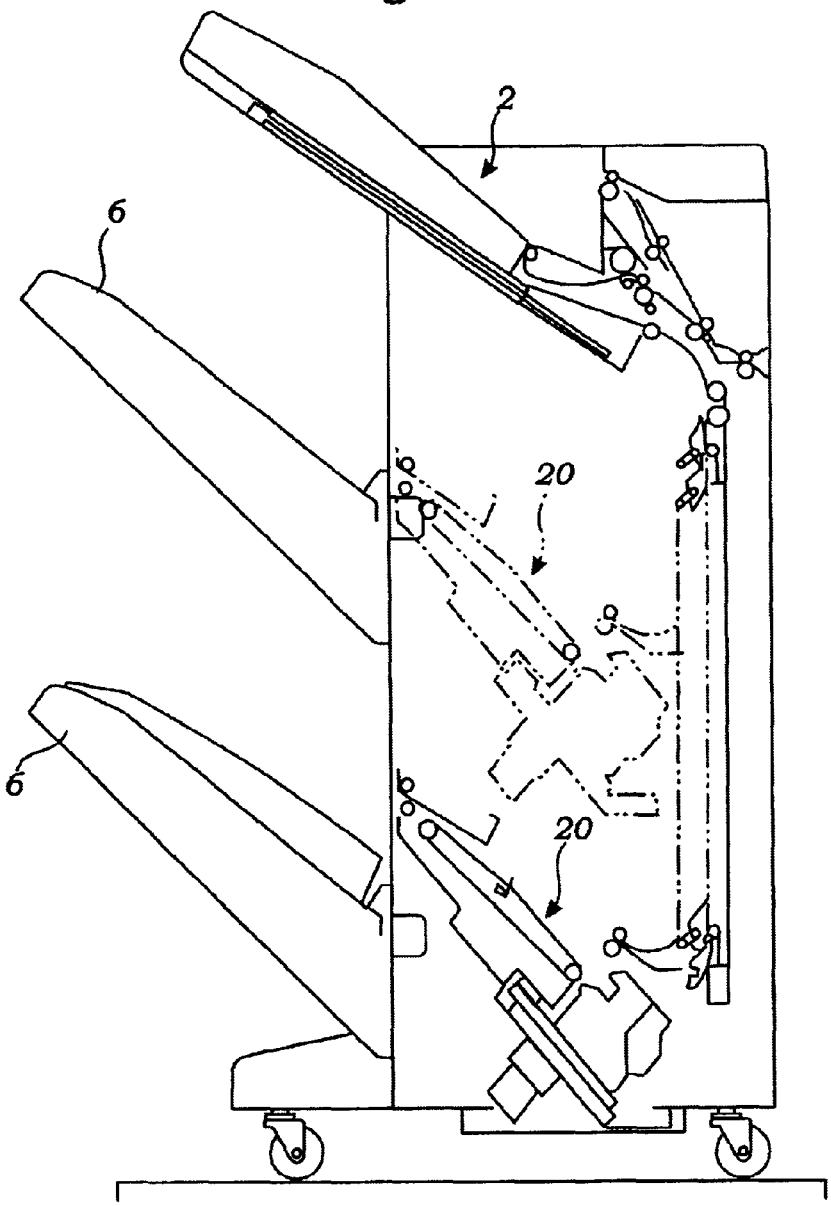
FIG. 18 is a side view to show still another installation format of the tray of the device in FIG. 1.

There are other constructions possible. FIG. 17 is an example of the installation of the tray 6 and FIG. 18 is an example of a total of two trays 6. The trays 6 are installed to several tray installation portions each corresponding to several outlets 4 and the sheet S or a pile of sheets can be sorted into these trays 6.

As described above, the sheet post processing device of this invention can selectively move the sheet sending device in the opposite directions to several outlets that are fixed in the same position as several fixed transport gates. The sheet sending device of the sheet post processing device sends the sheet that was transported from the transport gate according to its position and sorts the sheet onto the fixed tray corresponding to the outlet. Since it can sort sheets by moving the sheet sending device without moving the tray, it helps to simplify and minimize composition of the entire device and it can also sort sheets like a fixed tray functioning as a mailbox.

Figure 19:
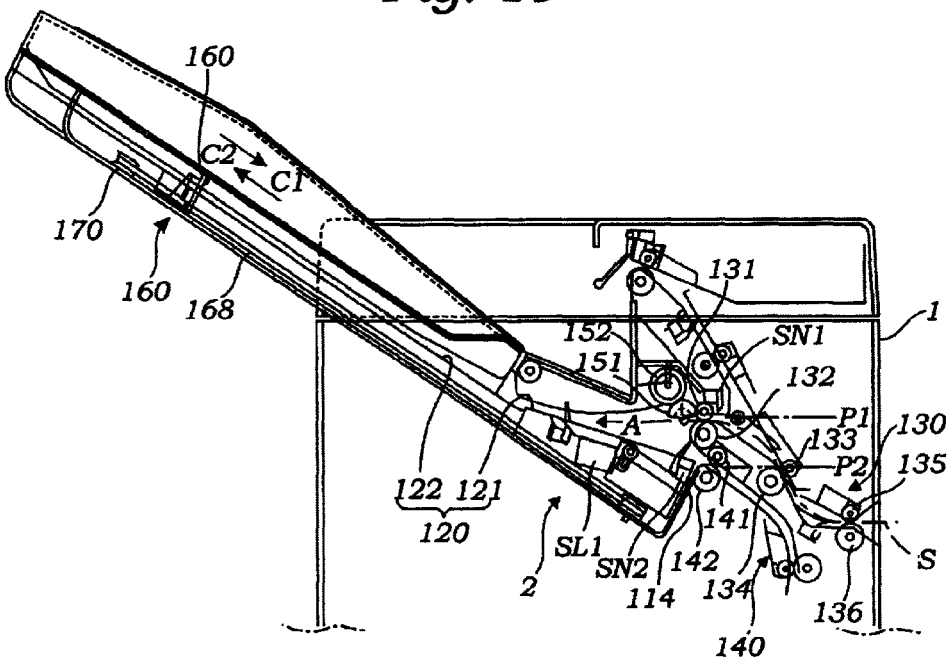
FIG. 19 is a side view of the sheet reversing device of this invention.
Figure 26:
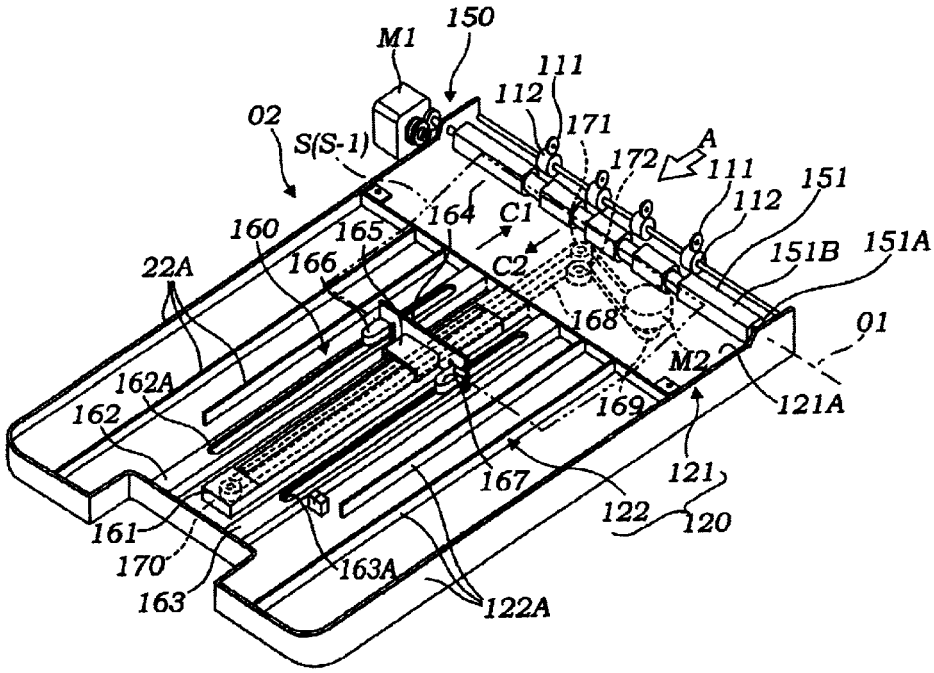
FIG. 26 is a perspective of the main part when the first sheet is transported into the sheet reversing device in FIG. 19.

The sheet reversing device 2 is constricted to keep the sheet S retained on the stage 120 on the top right diagonal direction in FIG. 19. In this example, this stage 120 is composed of the first section 21 with the inclined angle on the right side of FIG. 19 and the second stage 122 with the larger inclined angle on the left side of FIG. 19. As indicated in FIG. 26, the first stage 121 is a flat section 121A and a second is a ribbed section 122A.

In FIG. 19, P1 is a sheet transport established between upper and lower rollers 131 and 132 located near the top of the stage 120. P2 is also a sheet transport established between upper and lower transporting rollers 141 and 142 located at the low end of the stage 120. The transporting rollers 131 and 132 compose the sheet transport mechanism 30 along with upper and lower rollers 133, 134, 135 and 136. They send the sheet S as indicated by the two-point chain line in FIG. 19 that was ejected from a host machine such as a copier or a printer in the arrow A direction and transport it from the sheet transporting position P2 on the stage 120. SN1 is a transporting position sensor to detect the passage of the sheet S transported from the sheet transport position P2. SN2 is a transporting position sensor to detect the passage of the sheet S transported from the sheet transport position P2. The sending rollers 141 and 142 compose a sheet transport mechanism 140 to send the sheet S located in the sheet transport position P2 into the sheet transport path 10 along the arrow B direction in FIG. 2.

Figure 20:
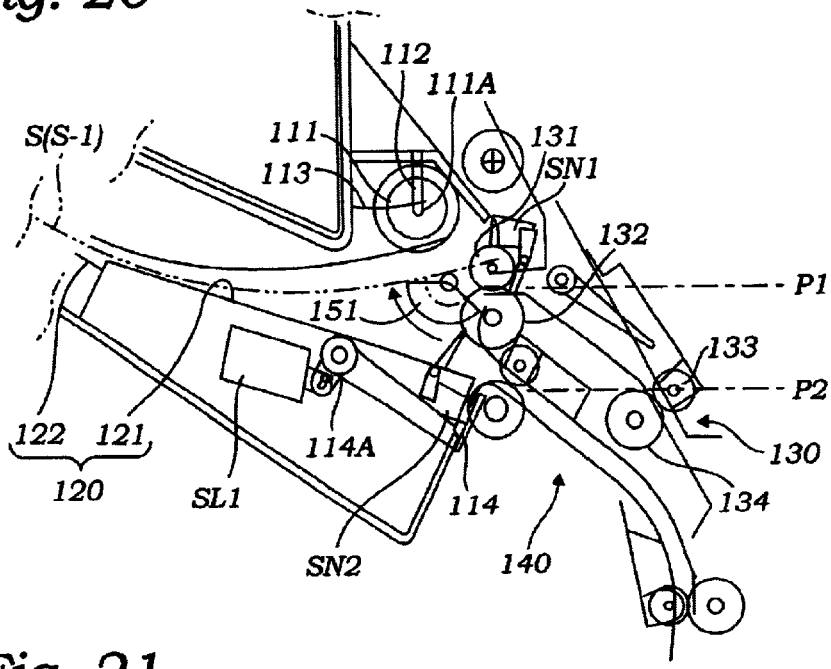
FIG. 20 is a side view of the main part to explain the movement when the first sheet is transported into the sheet reversing device in FIG. 19.
Figure 21:
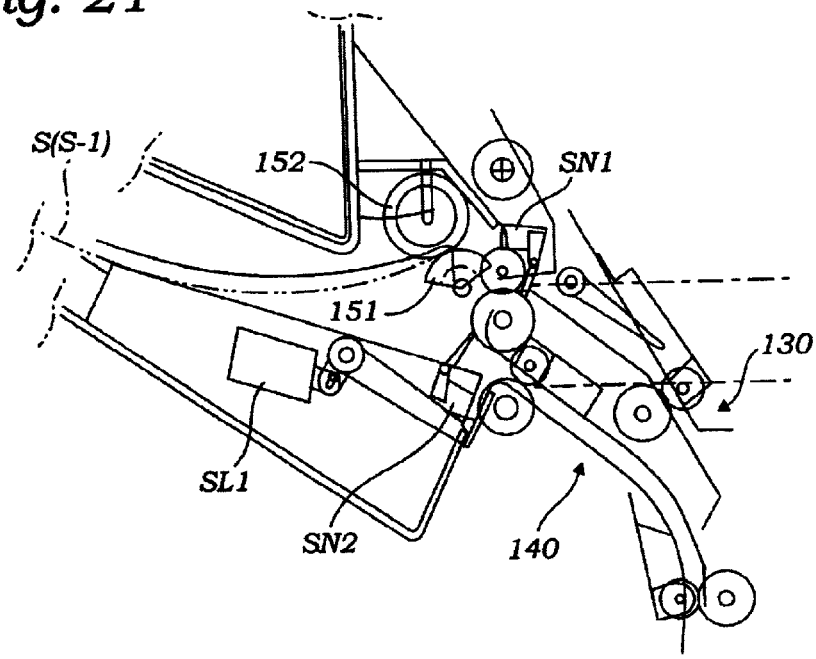
FIG. 21 is a side view of the main part to explain other movement when the first sheet is transported into the sheet reversing device in FIG. 19.
Figure 27:
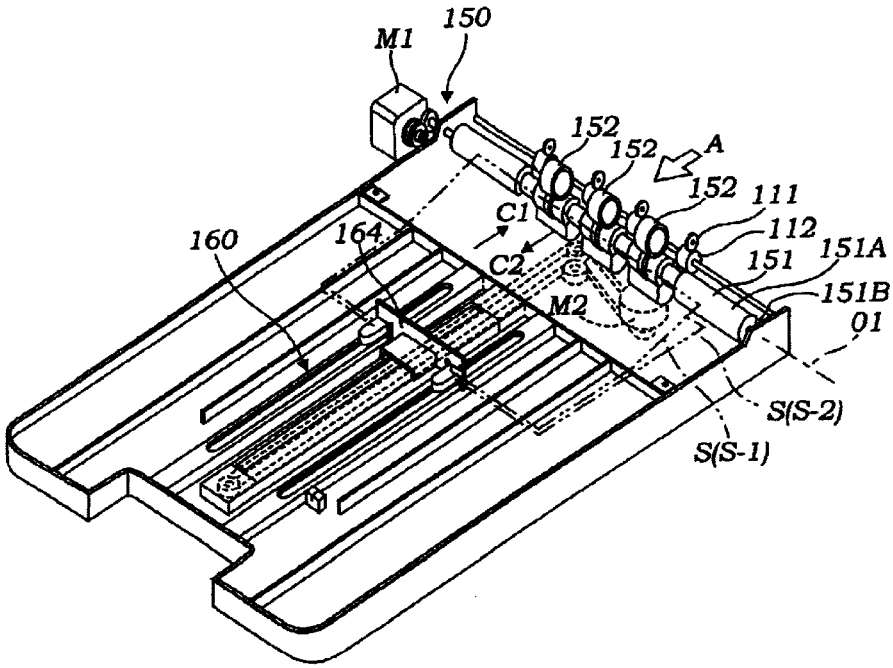
FIG. 27 is a perspective of the main part when the second sheet is transported into the sheet reversing device in FIG. 19.

A reversing guide 151 is a rotary body located in the left of the sheet transport position P1 of rollers 131 and 132. It is located in the repositioning device 150 (see FIG. 26) to temporarily reposition the rear end of the sheet S transported from the sheet transport position P1 on the top of sheet transport position P1. The section of that reversing guide 51 is a half moon shape that can rotate around the horizontal shaft line 01. It is also divided into several guides along the shaft line 01 and they rotate through a gear row by the reversing guide motor M1. The reversing guide 51 rotates between the waiting position as indicated in FIG. 20 or the stock position (usually the same position as the transporting position) as indicated in FIG. 21. The stock waiting position is the first position with the swelled portion 151A in a diameter direction of the reversing guide 151 located in the lower portion as indicated in FIG. 26 and the cut-out portion 151B located in the upper portion. The normal position (usually the same position as the transport position) is the second position rotated 150 degrees to the right from the waiting position as indicated in FIG. 27. The reversing guide 151 guides the sheet S from the sheet transport position P1 onto the top of the stage 120 through its cut-out portion 151B as mentioned later. Its swelled portion 151A reposition the rear end of the transporting direction of the sheet S upward.

The friction roller (elastic material) 111 is located on the top of the reversing guide 51. The shaft 111A of this friction roller 111 is guided freely up and down in the guide slit 112 on the body side of the sheet reversing device 2 as indicated in FIG. 20. It is also pushed downward by the spring 13.

A stopper 114 is located on the right end of FIG. 20 of the first stage 121 and can move up and down to position the front end of the infeed direction of the sheet S. This stopper 114 moves up and down by rotating around the supporting shaft 114A by the stopper solenoid SL1.

The sheet transporting mechanism 60 is located on the stage 120 to send the sheet S that is transported onto the stage 120 toward the sheet transport position P2. The sheet transporting mechanism 160 in this example has the pusher 164 that guides the second stage 122 to be able to slide in the arrows C1 and C2 directions by the guide bodies 161, 162 and 163 as indicated in FIG. 26. This pusher 164 is a flanged section of the guide block 165 that is guided to freely slide in the guide body 161, the guide blocks 166 and 167, that is, it guides to freely slide in the guide slits 162A and 163A of the guide bodies 162 and 163. The pusher 164 is connected to the belt 168 that moves by the pusher motor M2 and the belt 168 is hung between the drive pulley 169 of the pusher motor M2 and the guiding pulleys 170, 171 and 172. The pusher 164 is driven on the belt in the arrows C1 and C2 directions by the pusher motor M2.

Figure 30:
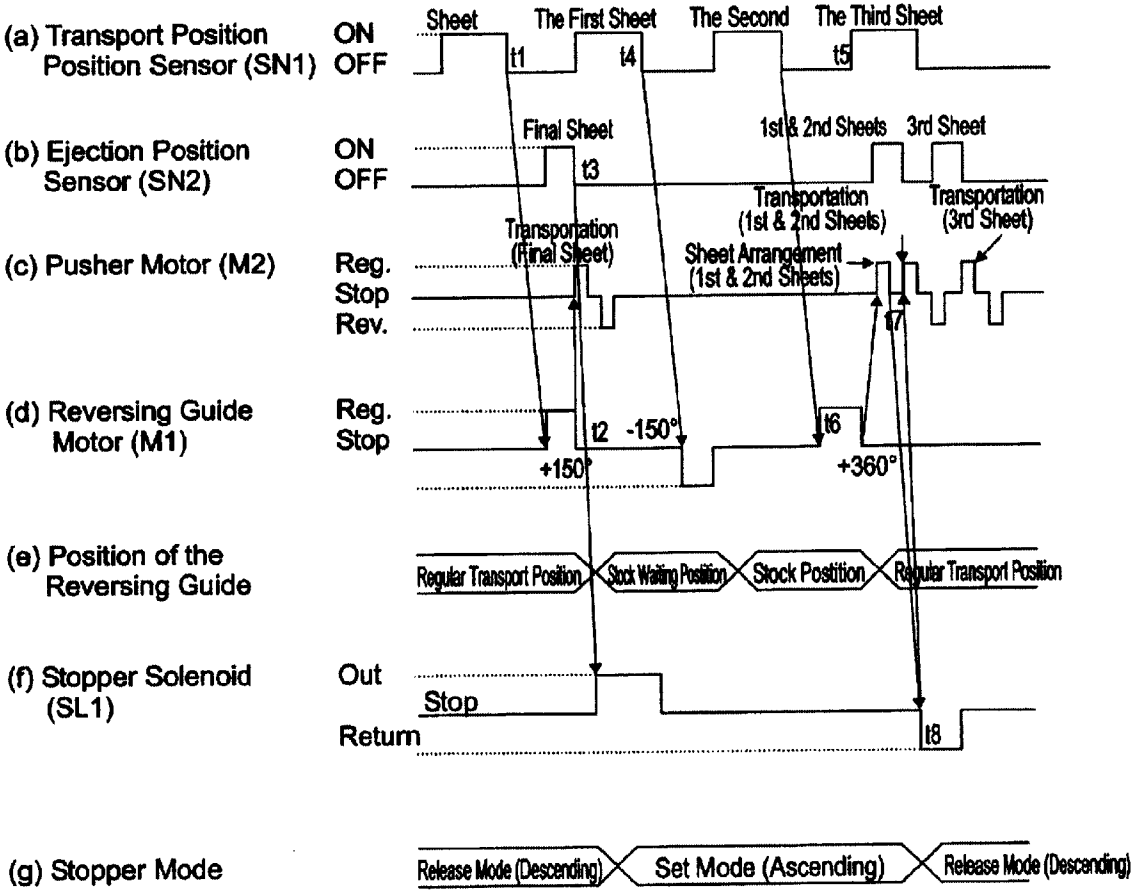
FIG. 30 is a timing chart to explain the movement of the sheet reversing device.

FIG. 30 is a timing chart to explain examples of the movements of the sheet reversing device 2. In this example, the sending mechanism 20 accumulates three pieces of the sheet S, staples that pile of sheets by the stapler 80, and transports them onto the tray 6. In such a sheet post processing, due to the time required for stapling after the third sheet S is accumulated in the sending mechanism 20, the sending mechanism 20 may not be able to continuously transport the first sheet S of the pile from the sheet reversing device 2. Examples of the movements of the sheet reversing device 2 in FIG. 30 are applications of such sheet post processing.

The sheet S is transported into the sheet reversing device 2 from the sheet transport position P1 and is detected by the transport position sensor SN1 as indicated in FIG. 30. If the final or the third sheet S of the pile is transported, the reversing guide motor M1 rotates in a regular direction for the specified amount after waiting for the third sheet S to be completely transported onto the stage 120 from the time when the detection signal of the transport position sensor SN1 is activated (t1). The reversing guide 51 rotates 150 degrees to the left from the regular transport position as indicated in FIG. 19 and sets itself in the stock waiting position as indicated in FIG. 20. After the time t2 when the reversing guide 151 rotates to the stock waiting position in FIG. 20, the pusher motor M2 rotates in a regular direction and then in a reverse direction. By the regular rotation of the pusher motor M2, the pusher 164 moves from the position in FIG. 19 to the arrow C1 direction, pushes the third sheet S on the stage 120, and sends it toward the sheet transport position P2. The third sheet S is transported from the sheet transport position P2 by the sheet transporting mechanism 140. Therefore, the third sheet S is transported from the sheet transport position P2 from the rear end of the transporting direction as the front end and the transporting direction is reversed. The pusher 164 moves in the arrow C2 direction by the reverse rotation of the pusher motor M2 and return to the waiting position in FIG. 19.

Figure 22:
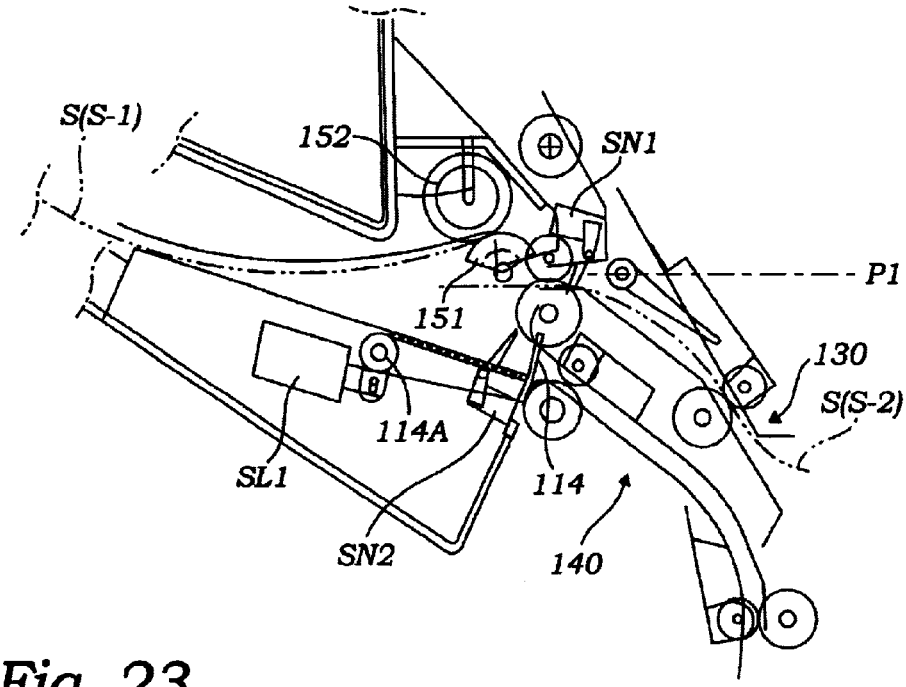
FIG. 22 is a side view of the main part to explain the movement when the second sheet is transported into the sheet reversing device in FIG. 19.

The third sheet S that is transported from the sheet transport position P2 is detected by the transport position sensor SN2 as indicated in FIG. 14(*b*). After the time when the detection signal of that sensor SN2 is activated, that is, after the third sheet S is transported, the stopper solenoid SL1 moves out and the stopper 114 elevates to be in the set mode as indicated in FIG. 22 (see FIGS. 14(*f*) and (*g*)). In this example, the transporting speed of the sheet S by the sheet transporting mechanism 140 is established slower than the transporting speed of the sheet transporting mechanism 30. In FIG. 30, the ejection position sensor SN2 detected the third sheet S before the regular rotation of the pusher motor M2 starts. This is because the third sheet S is transported from the sheet transport position P1 and naturally reached at the sheet transport position P2.

Then, if the first sheet S of the next pile of the sheets ("the first sheet S-I") is transported, it passes over the reversing guide 151 and is transported onto the stage 120 as indicated in FIG. 20. After the time t4 when the detection signal of the transport position sensor SN1 activated, the reversing guide motor M1 rotates in a reverse direction, the guide 151 rotates 150 degrees to the right from the stock waiting position in FIG. 20 and is set in the stock position as indicated in FIG. 21. The rear end of the transporting direction of the first sheet S-1 is lifted upward by the reversing guide 51 as indicated in FIG. 21, is repositioned on the top of the sheet transport position P1, and is held between the reversing guide 151 and the friction roller 111.

Figure 23:
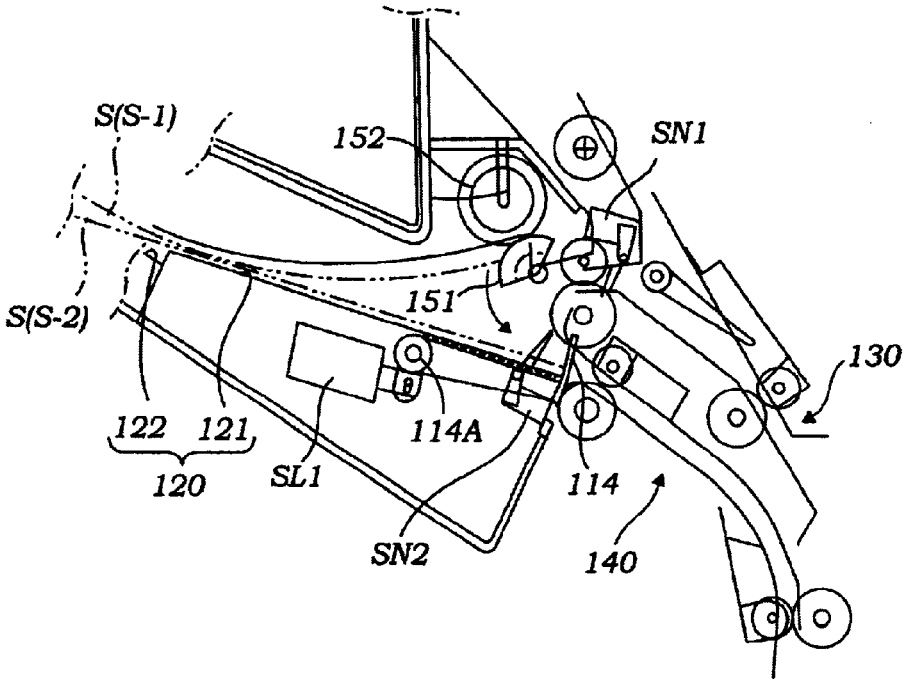
FIG. 23 is a side view of the main part to explain the movement when the first sheet is released from the sheet reversing device in FIG. 19.
Figure 24:
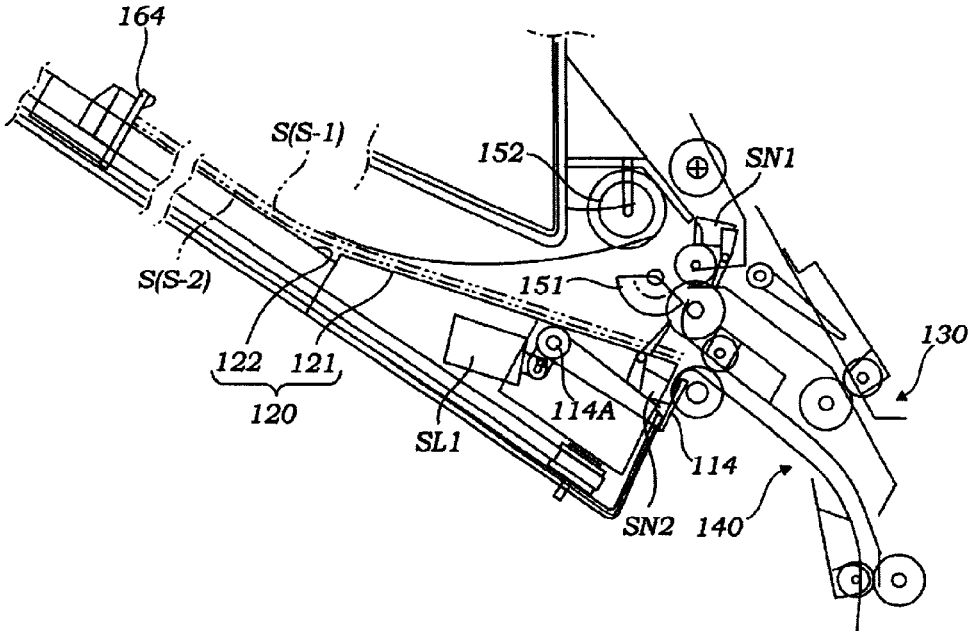
FIG. 24 is a side view of the main part to explain the movement when the first and second sheets start to be transported into the sheet reversing device in FIG. 19.
Figure 25:
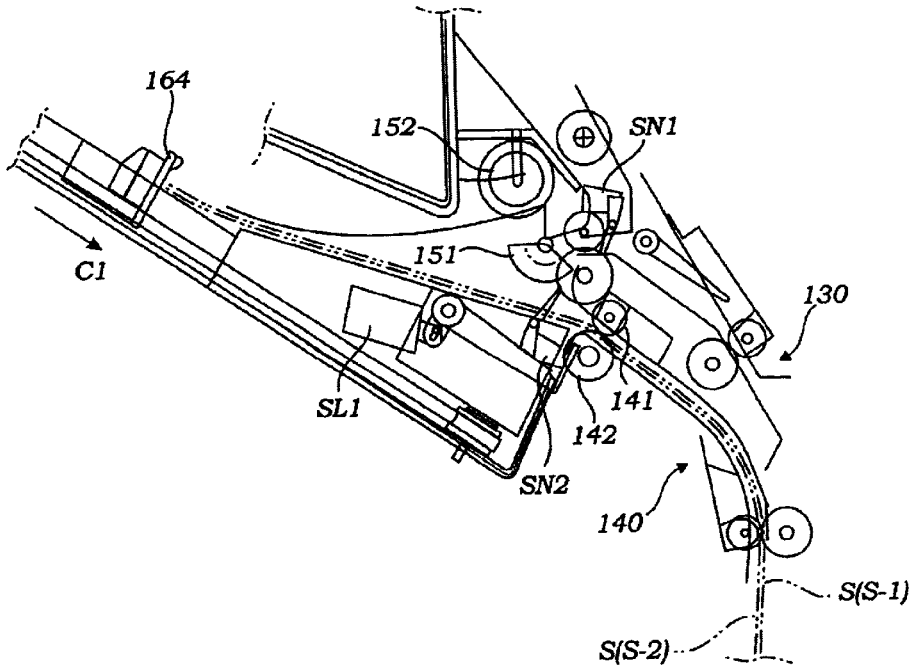
FIG. 25 is a side view of the main part to explain the movement when the first and second sheets are transported into the sheet reversing device in FIG. 19.

Then, the second sheet S transported from the sheet transport position P1 ("the second sheet S-2") is transported onto the stage 120 as it is being inserted under the first sheet S-1. And, after the time t5 when the detection signal of the transport position sensor SN1 is activated, the reversing guide motor M1 rotates in a regular direction, the reversing guide 151 rotates 360 degrees to the left as indicated in FIGS. 23 and 24 from the stock position in FIG. 22, and it returns to the regular transport position in FIG. 19. As indicated in FIGS. 23 and 24, the upward repositioning of the first sheet S-1 by the reversing guide 151 is released and the sheets are accumulated on top of the second sheet S-2.

And, after the time t6 when the reversing guide motor M1 stops rotating, the pusher motor M2 rotates in a regular direction over two stages as indicated in FIG. 14(*c*) and the pusher 164 sends the first and second sheets S-1 and S-2 in two stages. That is, the first stage transportation is to push small amounts of the sheets S-1 and S-2 to the arrow C1 direction and push the front end of the transporting direction to the stopper 114 to arrange those sheets. After the time t7 when this stage transportation is completed, the stopper solenoid SL1 returns as indicated in FIG. 14(*f*) and the stopper 14 comes down to be in a release mode as indicated in FIG. 24 (see FIG. 14(*g*)). The second stage transportation is conducted after the time t8 when the stopper solenoid SL1 returns and the pusher 164 sufficiently moves to the arrow C1 direction to send the sheets S-1 and S-2 to the transport position P2. Those sheets S-1 and S-2 are simultaneously transported from the sheet transport position P2 by the sheet transport mechanism 140.

Then, the third sheet S that is transported onto the stage 120 is transported to the sheet transport position P2 by the regular rotation of the pusher motor M2.

Figure 28:
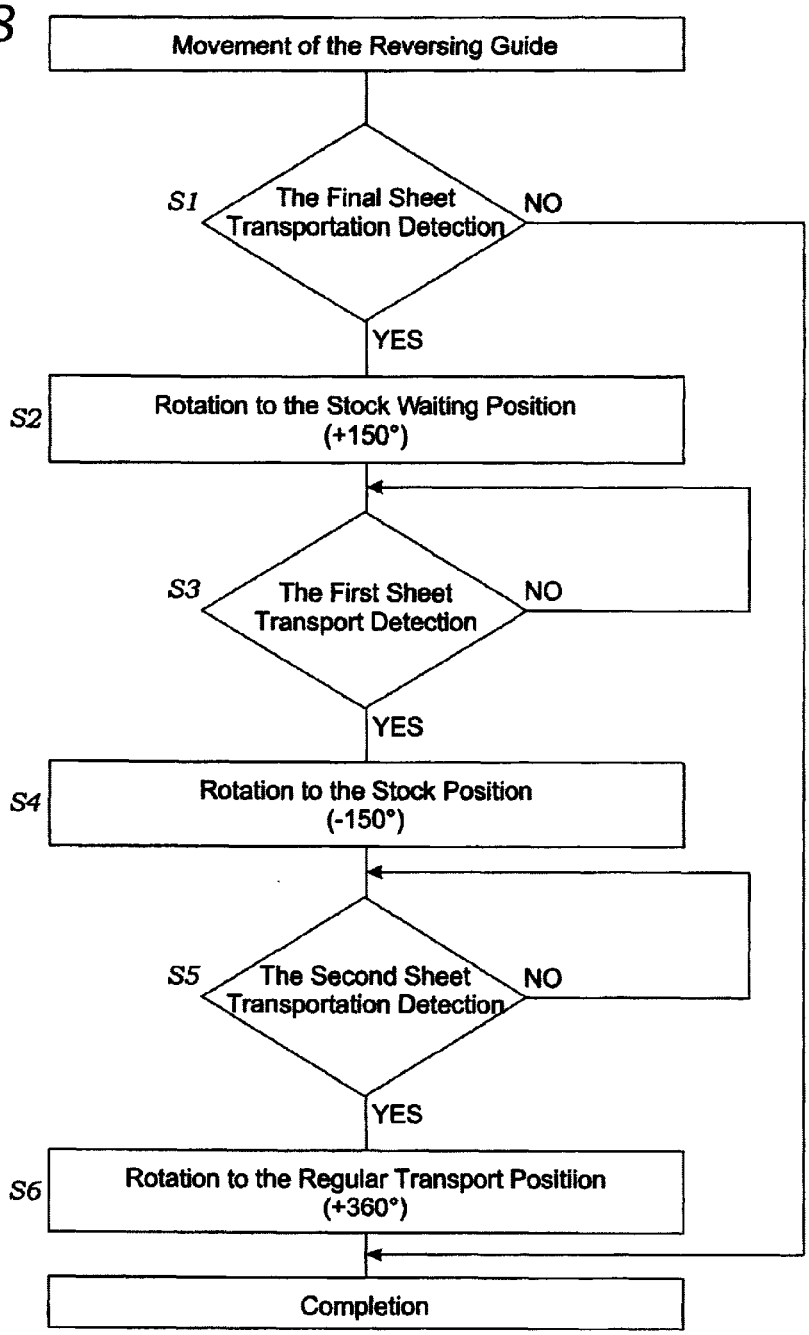
FIG. 28 is a flow chart to explain the movement of the reversing guide.

FIG. 28 is a flow chart to explain the movement of the sheet reversing guide 151. The sheet reversing guide 151 rotates to the stock waiting position from the regular transport position (steps S1 and S2) after transporting the final sheet (the third sheet). Then, the first sheet S-1 of the next sheet pile is transported and is rotated to the stock position (steps 3 and 4) and then the sheet reversing guide 151 rotates to the regular transport position after the second sheet S-2 is transported (steps S5 and S6).

Figure 29:
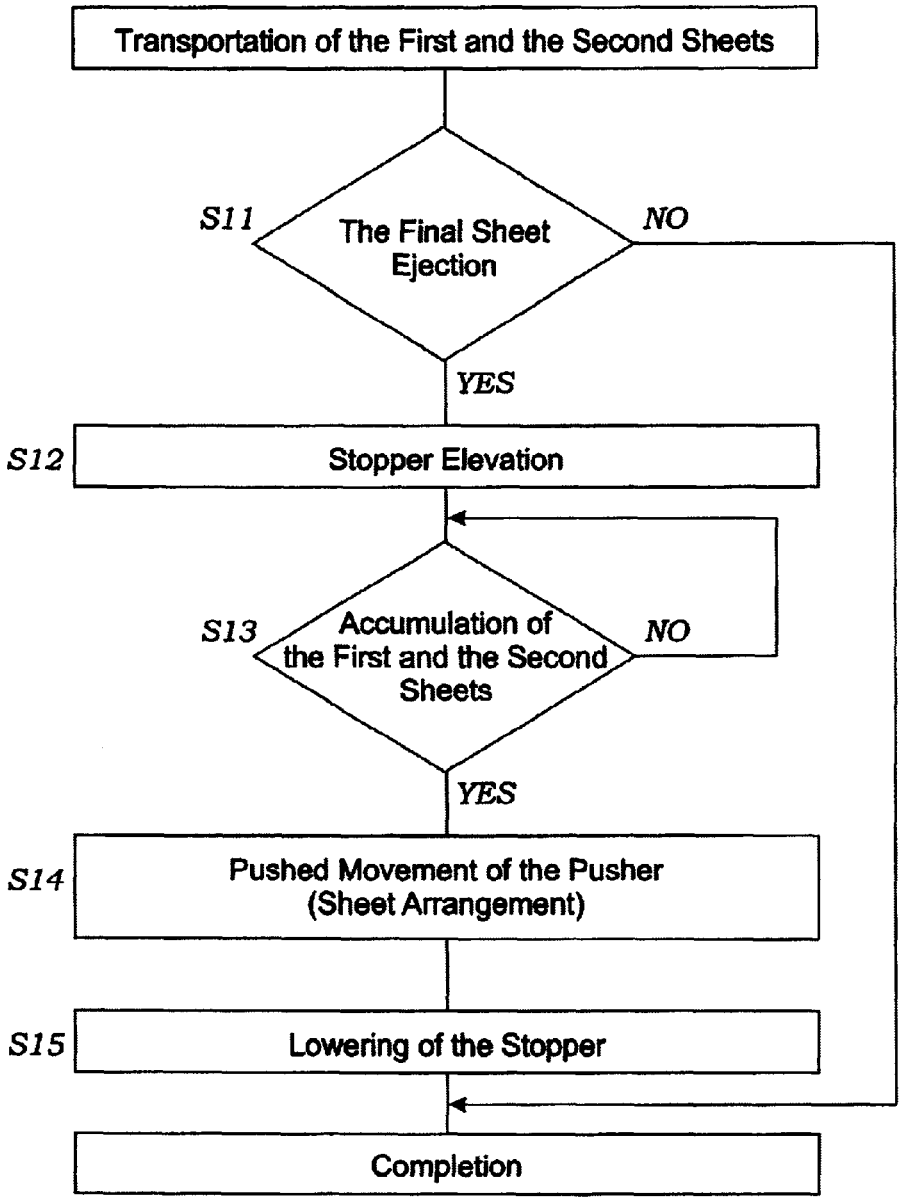
FIG. 29 is a flow chart to explain the transportation of the first and the second sheets by the sheet reversing device.

FIG. 29 is a flow chart to explain the transportation of the first and the second sheets S-1 and S-2 that are accumulated on the stage 120. After the final sheet (the third sheet) of the previous sheet pile is transported, the stopper 14 moves upward to be in a set mode (steps S11 and S12), then the sheets S-1 and S-2 are accumulated on the stage 120 (step S13) and are transported over two stages as mentioned before. that is, the pusher 164 arranges the sheets S-1 and S-2 in the first stage transportation, then pushes down the stopper 114 (step S15) and the pusher 164 transports the sheets S-1 and S-2 to the sheet transport position P2 in the second stage transportation (step S16).

The sheet reversing device 2 transports the first sheet S-1 and the second sheet S-2 together and delays the transportation of the sheet S-1 until the sheet S-2 is transported. It extends the period between the transportation of the final sheet (the third sheet) of the previous sheet pile and the transportation of the first and the second sheets S-1 and S-2 of the following sheet pile.

Stapling time of the sheet pile by the stapler 80 is secured within the extended period. By delaying the transportation timing of the sheet S to the sending mechanism 20 by the sheet reversing device 2, the sheet post processing delay due to stapling is compensated and the host machine can continuously transport the sheets S regardless of the delay in sheet post processing. Also, since the sheet reversing device 2 transports the first sheet S-1 over the second sheet S-2, the second and the third sheets S are accumulated over the first sheet S in the sending mechanism 20. Its accumulation order does not change.

As explained above, the sheet reversing device of this invention reposition the rear end of the transporting direction of the sheet transported previously on the stage upward, overlays the transported sheet on top of the next transported sheet, transports these sheets from the rear end of the transporting direction as the front end, continuously transports the sheet without being affected by the delay in movement of the sheet transporting destination, and effectively processes the sheets.

What is claimed is:

1. A sheet post processing device for receiving sheets from a sheet printing apparatus including: means for feeding sheets from the printing apparatus into the post processing device at an upper position, means for causing a first sheet to overlay a second sheet at said upper position, means for reversing the feed direction of the first and second and subsequent sheets, means forming a vertical feed path for moving the reversed sheets and feeding the sheets to a number of vertically spaced infeed locations, sheet sending means vertically movable selectively to said infeed locations including means for transporting sheets from said infeed locations, a number of outlets for receiving sheets transported by said means for transporting sheets and spaced vertically in a number of locations, whereby said means for transporting sheets is positionable between selected inlet locations and outlet locations, said apparatus having means for receiving sheets at said outlet locations.

2. A sheet post processing device as defined in claim 1, wherein said sending means includes means for stapling sets of sheets prior to transport of said sheets to one of said outlets.

3. A sheet post processing device as defined in claim 1, wherein said sheet sending means has means for arranging the sheets on said means for transporting sheets prior to transport of said sheets to one of said outlets.

4. A sheet post processing device as defined in claim 3, including stapling means associated with said means for transporting sheets for stapling the arranged sheets.

5. A sheet post processing device as defined in claim 3, including stapling means associated with said means for transporting sheets for stapling the arranged sheets in a plurality of locations.

6. A sheet post processing device as defined in claim 3, including stapling means associated with said means for transporting sheets for stapling the arranged sheets in a plurality of corner locations.

7. A sheet post processing device as defined in claim 1, wherein said vertically extended sheet feed path includes a series of vertically spaced gates at said infeed locations operable to deflect sheets from said vertically extended sheet feed path.

8. A sheet post processing device as defined in claim 1, wherein said means for receiving sheets includes a selected number of trays at selected outlet positions.

9. A sheet post processing device as defined in claim 1, including means for arranging sheets on said sheet sending means and means for pushing arranged sheets to said means for transporting sheets.

10. A sheet post processing device as defined in claim 1, including shutters at said outlet locations and means associated with said shutters and said sending means for selectively opening said shutters when sheets are fed to said means for receiving sheets.

11. A sheet post processing device as defined in claim 1, wherein said means for causing a first sheet to overlay a second sheet includes a rotary member of partly circular form rotatable between a first position holding the trailing end of said first sheet elevated for movement of the leading end of said second sheet beneath said first sheet, and means for rotating said partly circular member to release said trailing end of said first sheet.

12. A sheet post processing device as defined in claim 11, wherein said sending means includes means for stapling sets of sheets prior to transport of said sheets to one of said outlets.

* * * * *